US005516267A

United States Patent [19]

Ikeda et al.

[11] Patent Number: 5,516,267

[45] Date of Patent: May 14, 1996

[54] SCROLL COMPRESSOR HAVING A PRESSURE RELIEF MECHANISM USING AN OLDHAM COUPLING

[75] Inventors: Kiyoharu Ikeda; Hiroshi Ogawa; Yoshihide Ogawa; Kazuyuki Akiyama; Fumiaki Sano, all of Shizuoka, Japan

[73] Assignee: Mitsubishi Denki Kabushiki Kaisha, Tokyo, Japan

[21] Appl. No.: 220,685

[22] Filed: Mar. 31, 1994

[30] Foreign Application Priority Data

Sep. 22, 1993 [JP] Japan ..... 5-236566

[51] Int. Cl.[6] ..... F04C 18/04

[52] U.S. Cl. ..... 418/14; 418/55.1; 418/55.3; 418/55.5; 418/55.6; 418/57

[58] Field of Search ..... 418/55.1, 55.3, 418/55.5, 57, 55.6, 14; 464/102

[56] References Cited

U.S. PATENT DOCUMENTS

| | | | |
|---|---|---|---|
| 4,774,816 | 10/1988 | Uchikawa et al. | 418/55.1 |
| 5,071,329 | 12/1991 | Sano et al. | 418/55.3 |
| 5,328,342 | 7/1994 | Ishii et al. | 418/55.5 |
| 5,340,292 | 8/1994 | Steele | 418/55.1 |
| 5,342,184 | 8/1994 | Comparin et al. | 418/55.3 |

FOREIGN PATENT DOCUMENTS

| | | | |
|---|---|---|---|
| 60-75787 | 4/1985 | Japan . | |
| 62-17383 | 1/1987 | Japan . | |
| 3-237286 | 2/1990 | Japan . | |
| 3233178 | 10/1991 | Japan | 418/55.5 |
| 4179882 | 6/1992 | Japan | 418/55.3 |
| 4-303191 | 10/1992 | Japan . | |

*Primary Examiner*—John J. Vrablik

*Attorney, Agent, or Firm*—Oblon, Spivak, McClelland, Maier & Neustadt

[57] ABSTRACT

A scroll compressor comprising a rotation constraining device for restricting the rotation of the orbital scroll toward the principal axis rotational direction and for extending the constraining range of the orbital scroll toward the principal axis reverse rotational direction, and a compression chamber torque forming device for causing a pressure in a first compression chamber to be larger than that in a second compression chamber when the pressure in the compression chambers rises up abnormally high. The first compression chamber is formed between the wrap member inside surface of the fixed scroll and the wrap member outside surface of the orbital scroll and the second compression chamber is formed between the wrap member outside surface of the fixed scroll and the wrap member inside surface of the orbital scroll.

13 Claims, 18 Drawing Sheets

δo=aψ
ROTATIONAL MOMENT GENERATED BY PRESSURE IMBALANCE
3a
4
4a
194
1
191
201
ro
20

4b
ψ
8a
ENTRANCE (b)
193
A5
A4
A3
A2
A1
ENTRANCE (a)
8a
4b
3
192
PRINCIPAL AXIS ROTATIONAL DIRECTION
3a
4a
δo=aψ

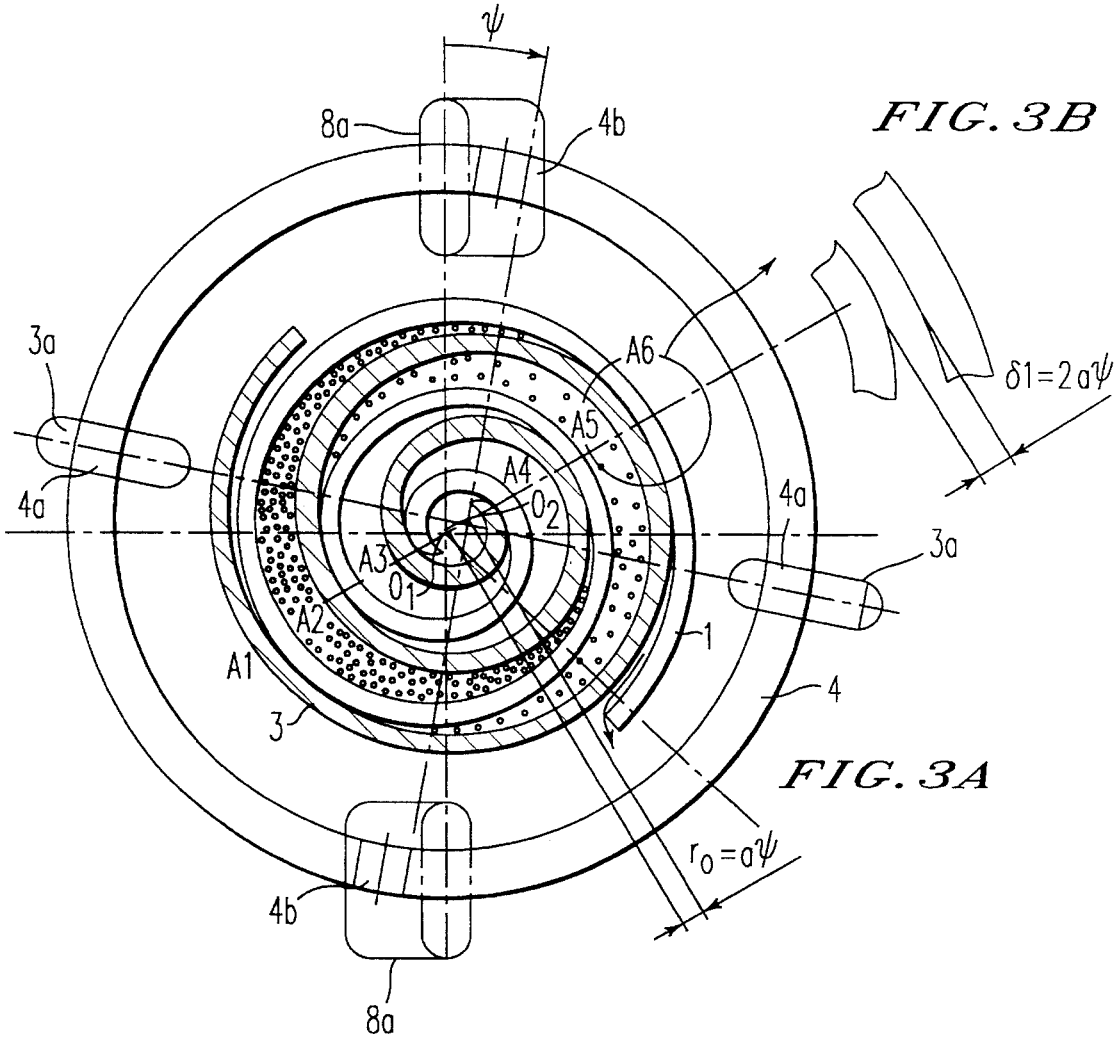
FIG. 3B
FIG. 3A
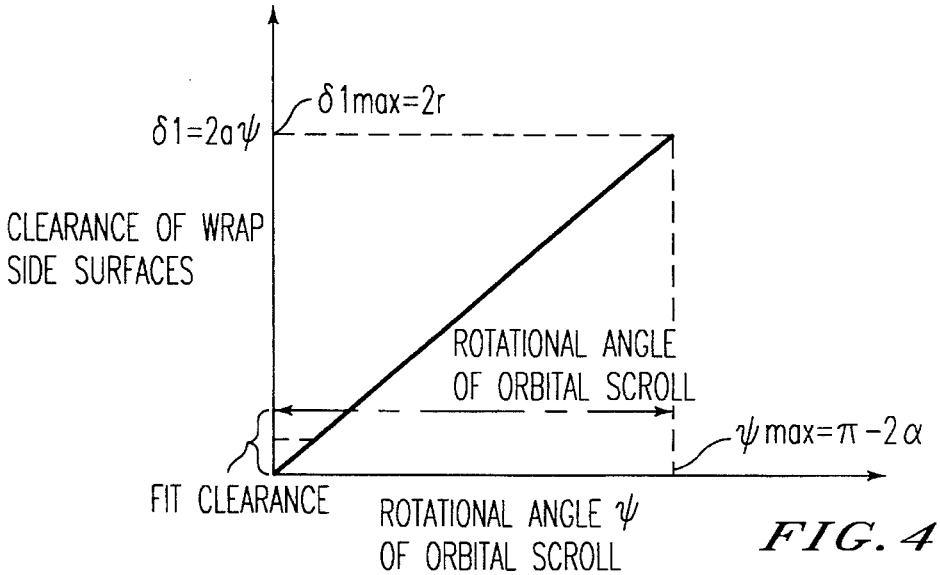
FIG. 4

SCROLL COMPRESSOR HAVING A PRESSURE RELIEF MECHANISM USING AN OLDHAM COUPLING

BACKGROUND OF THE INVENTION

1. Field of the Invention

The invention relates to a scroll compressor used, for instance, in an air conditioning machine or a refrigerator.

2. Description of the Related Art

FIG. 19 is a cross sectional view of the conventional scroll compressor which is disclosed in laid-open patent publication No. 3-237286. In FIG. 19, numeral 1 denotes a fixed scroll which has a wrap portion, 2, a discharge outlet formed almost at the center of the fixed scroll 1, 22, a discharge valve, 3, an orbital scroll having wrap members, 4, an Oldham ring which prevents the rotation of the orbital scroll 3 and gives moving motion to the orbital scroll 3, 5, a thrust bearing which receives thrust load from the orbital scroll 3, 6, a crank shaft which transfers the driving force from the electric motor to the orbital scroll 3, 6*a*, an eccentric pin installed at the top edge of the crank shaft 6, 21, a driving bush which transfers the rotational force of the crank shaft 6 to the orbital scroll 3 as an eccentric rotational force, 7, a centrifugal pump hole which is formed eccentrically in the crank shaft 6, 8, a main frame which supports the Oldham ring 4 and the thrust bearing 5, 9, a sub-frame, 10, a balance weight, respectively. The components shown in above-mentioned reference codes 1–10 comprise a compression element of the scroll compressor. Numeral 11 denotes a stator, 12, a rotor, respectively. These components 11 and 12 comprise an element of the electric motor.

The fixed scroll 1 in the compression element, the main frame 8 and the sub-frame 9 are fitted airtightly by such as shrink fit to the inside wall of a sealed shell 13. Thereby, a discharge muffler 14 and a suction pressure chamber 15, i.e. a suction pressure ambient atmosphere portion, are divided along the longitudinal direction. Furthermore, numeral 16 denotes a discharge pipe for discharging refrigerant gas, 17, a suction pipe for introducing the refrigerant gas, 18, a lubricating oil for providing it to the lubrication portion such as the compression bearing, respectively.

An operation of the aforementioned conventional scroll compressor is subsequently described. The force generated by the electric motor is transferred to the orbital scroll 3 through the crank shaft 6. The generated force causes the volume of the compression chamber 19 which is formed between a pair of the wrap members (protruded portions) of the fixed scroll 1 and the orbital scroll 3 to vary. Thereby, the compression chamber 19 intakes and compresses the refrigerant gas which flows toward inside from outside of the wrap members via the suction path 20 from the suction pipe 17. The compressed refrigerant gas is discharged from the discharge outlet 2 into the discharge muffler 14 and then discharged via the discharge pipe 16 to the outside of the compressor.

An oil feeding head is applied to a lubricating oil 18 at the bottom of the sealed shell 13 by the centrifugal force through the eccentric hole 7 of the crank shaft 6. The lubricating oil 18 goes up along the inside of the hole 7 and lubricates the sliding portion of the bearing, then is drained into the suction pressure chamber 15 and returns to the bottom of the sealed shell 13.

The orbital motion of orbital scroll 3 is permitted between the orbital scroll 3 and main frame 8, but the rotation of the orbital scroll 3 which rotates about its own axis is prevented by arranging the Oldham ring 4.

The function of the Oldham ring 4 is explained using FIG. 20. The Oldham ring 4 defines a doughnut shape. On the Oldham ring 4, a pair of protruding first keys 4*b* are formed on the bottom surface of the Oldham ring 4 and face an upper surface of the main frame 8, and a pair of second protruding keys 4*a* are formed on an upper surface and face a bottom surface of the orbital scroll 3. The first keys 4*b* and the second keys 4*a* are arranged perpendicularly each other. The key grooves 8*a* corresponding to the first keys 4*b* are formed on the upper surface of the main frame 8 and the key grooves 3*a* corresponding to the second keys 4*a* are formed on the back of the orbital scroll 3. Thereby, the Oldham ring 4 moves reciprocally for each groove, and therefore the rotation of the orbital scroll 3 is prevented.

FIG. 21 is a main cross sectional view as seen from the axis direction which shows a compression mechanism of the conventional scroll compressor. In FIG. 21, the orbital scroll 3 is engaged to the fixed scroll 1 at the position of a transversal direction separated by 180 degrees of the wrap phase by using the Oldham ring 4. The orbital scroll 3 is enforced by the eccentric rotating motion having a predetermined distance by the eccentric pin 6*a* located at the top edge of the crank shaft 6 and the driving bush 21 attached thereon. Respective volumes of a plurality of closed spaces (compression chambers) are decreased and compressed by the eccentric rotating motion of the orbital scroll 3. Where, O1 denotes a center of the fixed scroll 1 and O2 denotes a center of the orbital scroll 3. The distance between O1 and O2 denotes an orbital radius $r_0$ of the orbital scroll 3. In FIG. 21, the points where the fixed scroll 1 contacts the orbital scroll 3 are indicated by A1, A2, A3, A4, A5, A6. The closed spaces (compression chambers) are partitioned by these points.

The moment acting on the Oldham ring 4 is described using FIG. 22. FIG. 22 is an illustration which shows a rotational moment acting on the orbital scroll 3 at the normal operation of the conventional scroll compressor. The Oldham ring 4 prevents the rotation of the orbital scroll 3. A moment which causes the orbital scroll 3 to rotate around its own axis is generated by the reactive force which is generated against the force for compressing the refrigerant.

The reactive force Fθ against the force which is necessary to compress the refrigerant is directed toward the reverse rotational direction around the principal axis $O_1$ (or around the center point of the fixed scroll 1). The point of action corresponds to a middle point on the straight line between the principal axis center $O_1$ and the center $O_2$ of the driving bush 21 (or at the center of the orbital scroll 3) is shown in FIG. 24.

When this force Fθ is watched from driving bush 21 center $O_2$ (or at the center of the orbital scroll 3), the orbital scroll 3 receives the rotational moment M toward the same rotational direction as that of the principal axis 6. Accordingly, the keys 4*a* and 4*b* of the Oldham ring 4 are to receive the load at the surfaces which denies this rotational direction. The numeral 30 in FIG. 22 indicates portions where the Oldham ring key grooves usually receive this load and the orbital surfaces of the Oldham ring keys and the key grooves are formed at normal operation.

The fixed scroll 1 and the orbital scroll 3 continue the compressing operation using this Oldham ring 4 in keeping the relative phase difference of 180 degrees.

FIG. 23 is a cross sectional view which shows an enlarged Oldham key and a key groove of the conventional scroll compressor. In general, the clearance $\epsilon$ between the Oldham ring key and key groove is defined as a sliding surface fitting clearance which is set within the range of the desired dimensional tolerance at machining. This clearance $\epsilon$ is very strictly controlled to be as small as possible.

At a normal operation, if the clearance $\epsilon$ between the key and key groove in this sliding surface becomes large, the phase difference between the fixed scroll 1 and the orbital scroll 3 becomes large. If there arises the larger phase difference between the two wrap members, the clearance is formed between the wrap side surfaces and the airtightness of the compression chamber is ruined. As a result, the performance of the scroll compressor will largely deteriorate.

The variable crank mechanism using the driving bush 21 is described in FIG. 24. FIG. 24 is a main cross sectional view of the variable crank mechanism.

In order to seal the clearance, toward the radius direction, of wrap side surfaces of the scroll compressor, a crank having a variable orbital radius $r_0$ (or the orbital radius of orbital scroll 3) is used. In FIG. 24, $O_1$ is a rotating center of the principal axis, $O_2$ is a center of the driving bush 21. The driving bush 21 is installed on the eccentric pin 6*a* which is located at the top edge of the crank shaft 6. When the scroll compressor starts its operation, the reactive force Fθ and the radius direction force Fr (mainly centrifugal force) act to the center of the driving bush 21. The reactive force Fθ is against the force which compresses the refrigerant toward the center of the driving bush 21. The radius direction force Fr causes the crank radius O1~O2 (or the orbital radius $r_0$ of the orbital scroll 3) to increase, and causes the clearance between the wrap side surfaces to be zero automatically. As a result, the wrap side walls mutually push and touch as shown in A1~A6 of FIG. 21. Accordingly, the performance of the scroll compressor can be increased by this sealing effect.

In case of the conventional scroll compressor, at a stopping state of the compressor, especially when the compressor has been stopping for a long time and the temperature of the refrigerant is low, the refrigerant stored inside the refrigerating or the air conditioning equipment liquefies and abundantly flows into the inside of the compressor. In this case, the compressor shell and/or the suction path is filled with a lot of saturated liquid which abundantly dissolves the lubricating oil inside the compressor shell.

If the compressor is started in such a state, the space in which the saturated liquid stays is the same as that of the suction pressure space. Accordingly, at starting of the compressor, the refrigerant of saturated liquid is vaporized suddenly by the sudden pressure reduction changed from a balance state of pressure. The refrigerant of the saturated liquid becomes into a foam state according to the sudden pressure reduction and viscosity of lubricating oil.

Bubbles formed by the refrigerant and the lubricating oil are introduced into the compression chamber via the suction path 20. In this case, the pressure value which is generated inside the closed compression chamber becomes from several to several tens of times in comparison with the pressure value when the refrigerant is compressed under the normal operation. If such an abnormally high pressure is repeated, the wrap members formed by the comparatively thin shape break down without overcoming the pressure in the worst case. Even if the wrap members do not break down, the compression load according to the liquid compression suddenly increases. As a result, the driving torque of the electric motor falls behind the torque which compresses liquid refrigerant and a problem of the starting failure has been brought about.

Furthermore, when the liquid refrigerant containing a large quantity of lubricating oil is compressed and discharged out of the compressor, a quantity of the lubricating oil in the compressor decreases. As a result, an abnormal abrasion and a seizure of the sliding portion are caused by the feeding failure of the lubricating oil into the sliding portion of the compressor.

SUMMARY OF THE INVENTION

It is an object of the present invention to provide for a scroll compressor having a high reliability and improved starting characteristic, and for preventing a break down of the wrap members by relaxing an abnormal pressure rise in the compression chambers according to the liquid compression at starting where refrigerant is filled in the compressor shell.

According to one aspect of the present invention, there is provided a scroll compressor which comprises a fixed scroll defined by wrap teeth having a spiral shape which is formed on one side of the first bed plate, an orbital scroll defined by the wrap teeth substantially having the same spiral shape as that of the fixed scroll which is formed on one side of the second bed plate, the both wrap teeth are arranged so that they have a relative phase difference differentiated by 180 degrees and form a plurality of closed compression chambers, the volume of the closed compression chambers are gradually decreased and compressed by the relative orbital motion of the orbital scroll for the fixed scroll, the scroll compressor comprising rotation constraining means for restricting a rotation of the orbital scroll toward the principal axis rotational direction and maintaining the relative phase difference of the both wrap teeth differentiated by substantially 180 degrees, and for extending the constraining range of the orbital scroll toward the principal axis reverse rotational direction and changing the relative phase difference of the both wrap teeth; compression chamber torque forming means for causing a pressure in first compression chambers which is larger than that in second compression chambers when the pressure in the compression chambers rises up abnormally high, wherein the first compression chambers are formed between the wrap member inside surface of the fixed scroll and the wrap member outside surface of the orbital scroll and the second compression chambers are formed between the wrap member outside surface of the fixed scroll and the wrap member inside surface of the orbital scroll.

According to further aspect of the present invention, there is provided a scroll compressor further comprising a variable crank structure for varying the orbital radius of the orbital scroll.

According to further aspect of the present invention, there is provided a scroll compressor wherein the rotation constraining means comprises an Oldham coupling for constraining the orbital scroll against the fixed scroll toward the reverse rotational direction of the principal axis, wherein the constraining range is set at minimum to a rotation quantity corresponding to a sliding surface fitting clearance which is normally set at machining the Oldham coupling, and also the constraining range is set at maximum to a rotation quantity corresponding to a clearance where the crank radius of the orbital scroll becomes zero.

According to still further aspect of the present invention, there is provided a scroll compressor wherein the reverse rotational direction of the principal axis of the orbital scroll is restricted by extending the Oldham groove width or reducing the Oldham key width.

According to another aspect of the present invention, there is provided a scroll compressor wherein the sliding surface of the Oldham groove and the sliding surface of the Oldham key slide in parallel when the orbital scroll rotates toward the reverse rotational direction of the principal axis.

According to further aspect of the present invention, there is provided a scroll compressor wherein an elastic body is equipped on the Oldham groove side surface which becomes a sliding side when the orbital scroll rotates toward the reverse rotational direction of the principal axis.

According to still further aspect of the present invention, there is provided a scroll compressor wherein at least a stage is formed on the Oldham groove side surface which becomes a sliding side when the orbital scroll rotates toward the reverse rotational direction of the principal axis.

According to another aspect of the present invention, there is provided a scroll compressor wherein an inclined surface is formed on the Oldham groove side surface which becomes a sliding side when the orbital scroll rotates toward the reverse rotational direction of the principal axis.

According to further aspect of the present invention, there is provided a scroll compressor wherein the compressor torque forming means comprise a suction path aperture which is formed near an entrance of the first compression chambers rather than the second compression chambers.

According to still further aspect of the present invention, there is provided a scroll compressor wherein the compressor torque forming means comprise a flow resistor which is formed in the refrigerant flow path near an entrance of the second compression chambers.

According to another aspect of the present invention, there is provided a scroll compressor of transverse type wherein the compressor torque forming means comprise an entrance of the first compression chambers which is located at a lower half of the horizontal direction of the transverse type scroll compressor.

According to further aspect of the present invention, there is provided a scroll compressor wherein the compressor torque forming means comprise a valve for connecting the second compression chamber to a discharging space.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3 is a main cross sectional view of a scroll compressor of the first embodiment of the present invention.

FIG. 4 is an illustration which shows a relation between the clearance of wrap side surfaces and the rotation angle of the orbital scroll of the first embodiment of the present invention.

DETAILED DESCRIPTION OF THE PREFERRED EMBODIMENTS

Embodiment 1

Figure 1:
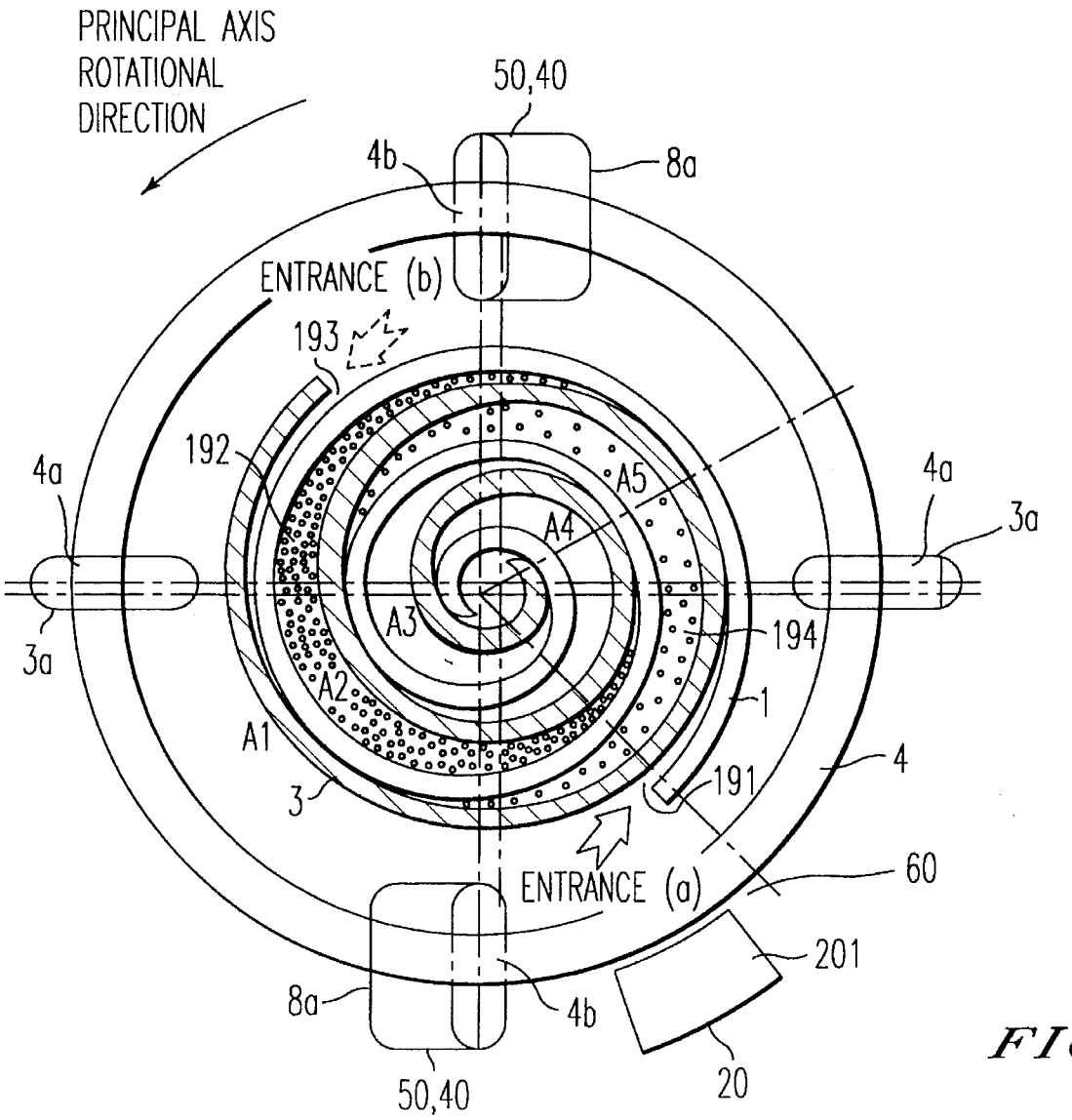
FIG. 1 is a main cross sectional view of a scroll compressor of the first embodiment of the present invention.
Figures 2A, 2B, 2C:
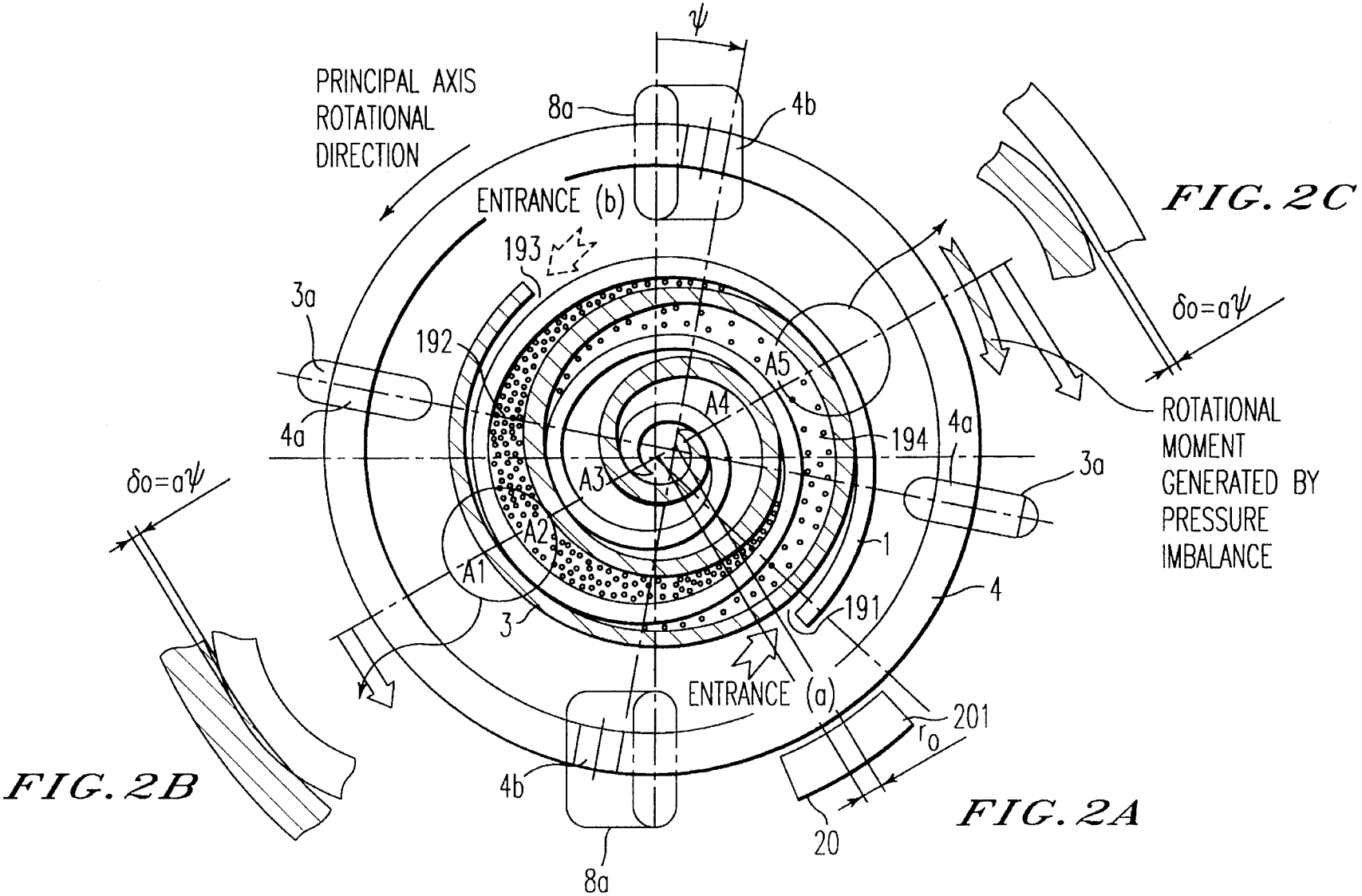
FIG. 2 is a main cross sectional view of a scroll compressor of the first embodiment of the present invention.

The first embodiment is explained using FIG. 1~FIG. 6. FIG. 1~FIG. 3 are illustrations which explain the operational principle which reduces the high pressure refrigerant.

FIG. 4 is an illustration which shows a relation between the rotation angle $\psi$ (which is toward reverse rotational direction of the principal axis of the orbital scroll 3) and the clearance $\delta_1$ between the wrap side surfaces of the first embodiment of the present invention.

In FIG. 1~FIG. 3, the same components as those shown in FIG. 10~FIG. 20 are marked with the same numerals and the description thereof is herein omitted. In FIG. 1~FIG. 3, the key groove 8*a* of the main frame 8 is intentionally enlarged.

An operation of the first embodiment is explained hereinafter. Since the space where the electric motor is equipped and the space where the compression chamber is arranged are connected through the suction path 20 of the main frame 8, the mixture of a large quantity of liquid refrigerant and the lubricating oil which have been filled in the electric motor shell are intaken into the compression chamber 19 through the suction path 20 and its aperture 201 with violently generated foam at starting.

Since the scroll compressor has a corresponding plurality of crescent moon type compression chambers, the refrigerant is intaken into the compression chambers via the two entrances which are located at an opposite location and separated by 180 degrees.

If the rotational direction of the principal axis is assumed to be in a counter-clockwise direction, most of the mixture mixed with the foamed refrigerant containing the rich liquid and the lubricating oil is intaken from the entrance (a) 191, by arranging the aperture 201 of the main frame suction path 20 (which is led to the electric motor space) near the entrance (a) 191 of the compression chamber (a) 192 (first compression chamber). The compression chamber (a) 192 (first compression chamber) is formed by the inside surface of the fixed scroll 1 and the outside surface of the orbital scroll 3.

On the other hand, the refrigerant which is intaken from the entrance (b) 193 has a comparatively low liquid ratio. The above entrance (b) 193 is an entrance of the compression chamber (b) 194 (second compression chamber) having the same shape as that of the compression chamber (a) 192 which is located at the opposite location separated by 180 degrees. The compression chamber (b) 194 (second compression chamber) is formed by the outside surface of the fixed scroll 1 and the inside surface of the orbital scroll 3.

When the compression operation progresses under the condition of the above imbalance liquid ratio, a large pressure difference is caused between the compression chamber (a) 192 and the compression chamber (b) 194. In this case, the pressure difference is considerably larger in the compression chamber (a) 192, which contains a lot of liquid refrigerant, rather than in the compression chamber (b) 194.

When the rotational moment M acting on the orbital scroll 3 is taken into consideration, the rotational moment M acting toward the rotational direction of the principal axis at the normal operation state acts toward the reverse rotational direction of the principal axis, if the torque balance collapses by the abnormal rise of the pressure in the compression chambers (a) 192.

Figure 5A:
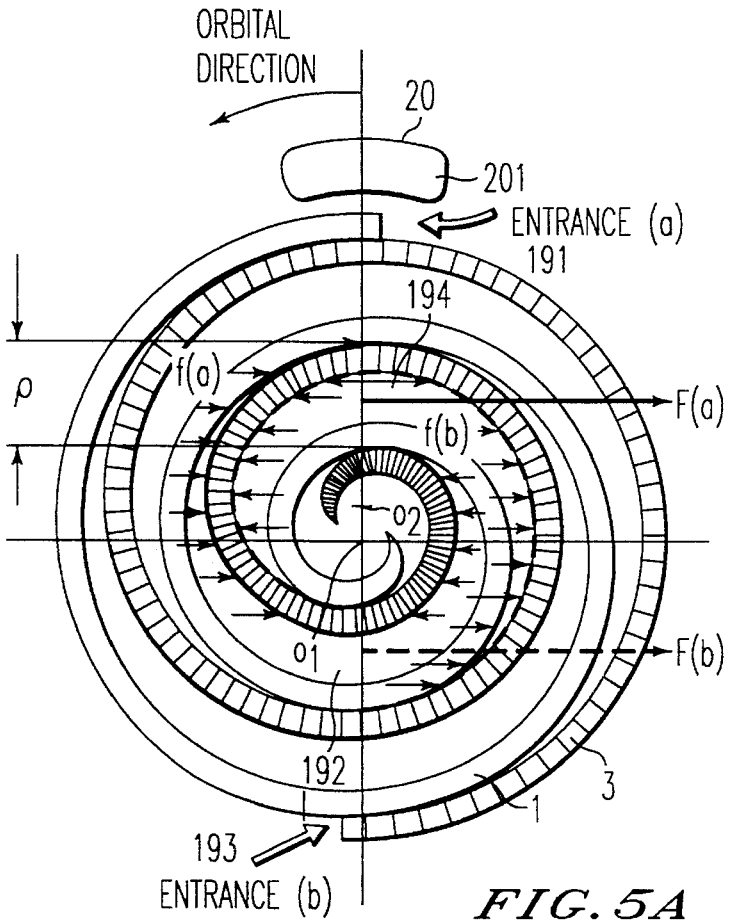
FIG. 5A is an illustration which explains the direction of the rotation acting on the orbital scroll of the first embodiment of the present invention.
Figure 5B:
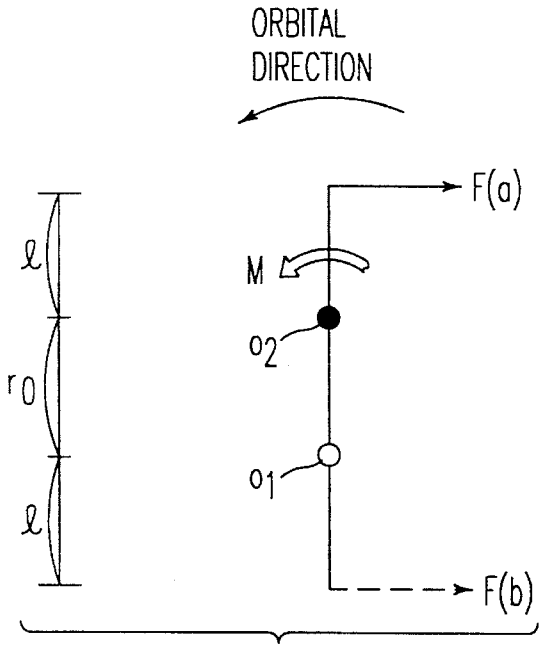
FIGS. 5B and 5C show simplified forces F(*a*) and F(*b*) in FIG. 5A.
Figure 5C:
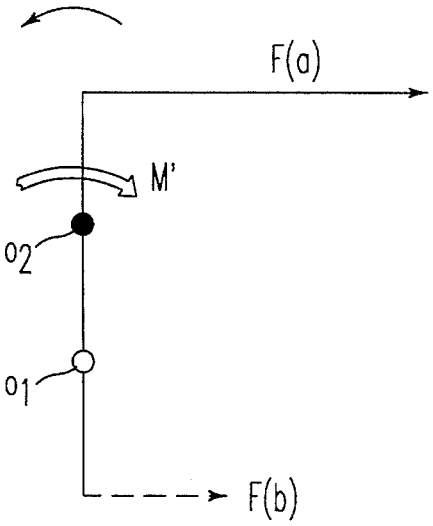

This principle operation is explained by using FIGS. 5A, 5B and 5C.

FIG. 5A is an illustration which explains the rotational direction acting on the orbital scroll of the first embodiment of the present invention. When a pair of compression chambers are taken into consideration, the internal force which acts on the orbital scroll 3 from the compression chamber (a) 192 is f(a) and the total force is F(a) as shown in FIG. 5A. This total force F(a) acts on the distance p toward the arrow direction as shown in FIG. 5A.

In the same way, the force acting on the orbital scroll 3 from the compression chamber (b) 194 is f(b) and the total force is F(b) as shown in FIG. 5A. This total force F(b) acts on the distance p toward the arrow direction as shown in FIG. 5A.

These forces F(a) and F(b) are simplified as shown in FIG. 5B. The distance between $O_1$ and $O_2$ is an orbital radius. Where, lets assume the distances $O_1n=O_2m=1$.

At the normal operation, the pressures at the compression chamber (a) 192 and the compression chamber (b) 194 are equal, then the following equation is obtained.

$$F(a)=F(b)$$

When looking at these forces from the orbital scroll center $O_2$, the moment F(b) is given in the following equation.

$$F(b)\times(r_0+1)>F(a)\times 1$$

That is, the moment F(b) acts toward the direction shown by the arrow M. In other words, this rotational direction is the same as that of the main axis (orbital direction) as shown in FIG. 5B.

When a large quantity of liquid refrigerant is intaken into the compression chamber (a) at starting after stopping state, the pressure of the compression chamber (a) becomes abnormally high.

Therefore, the following relation is given.

$$F(a)>>F(b)$$

The force acting on the orbital scroll 3 is shown in FIG. 5C. The moment M' around the orbital scroll center $O_2$ in case that F(a) became excessive is given in the following relation.

$$F(a)\times 1>F(b)(r_0+1)$$

This moment M' acts toward the reverse direction rather than that of the principal axis as shown in FIG. 5C.

Since the Oldham ring key and the key groove are usually formed to have the same dimension except the tolerance which is permitted at the machining, even if these rotational moments act toward any direction, the Oldham ring absorbs all rotational moments and then the rotation of orbital scroll 3 is prevented.

According to the present invention, since the clearance $\epsilon$ between the Oldham ring key and the key groove at the non-sliding side surface becomes large, the orbital scroll 3 can be rotated on its own axis toward a reverse rotational direction of the principal axis. When the orbital scroll 3 rotates around on its own axis by angle $\psi$ without changing the orbital radius, the distance between the wrap side surface of the fixed scroll 1 and the wrap side surface of the orbital scroll 3 at the contact point separates by the clearance $\delta_0$ at the contact points A4~A6 as shown in FIG. 2.

This clearance $\delta_0$ is given in the following equation, if assuming the rotation angle of orbital scroll 3 is $\psi$, and the radius of the wrap member is a.

$$\delta_0=a\psi \quad (1)$$

On the other hand, the contact points A1~A3 located at the opposite direction and separated by 180 degrees interfere by the distance 60 as shown in FIG. 2. But in case of the scroll compressor having the movable crank mechanism, the driving bush 21 moves toward the direction which decreases the orbital radius by the distance $\delta_0$ as shown in FIG. 3.

As a result, the orbital scroll 3 moves toward the contacting direction in parallel by the distance $\delta_0$. Accordingly, the orbital scroll 3 contacts to the fixed scroll 1 by zero clearance at the contact points A1~A3, and the other clearances at the contact points A4~A6 become $\delta_1$.

Where, $$\delta_1=2a\psi \quad (2)$$

As described above, when the orbital scroll 3 rotates around against the principal axis in this situation, the abnormal high pressure in compression chamber (a) can be reduced by the clearance $\delta_1$ of the side wall of the wrap member. That is, the high pressure refrigerant in the compression chamber (a) goes out to the outside of the compression shell.

In the above embodiment, the explanation is carried out in case that the scroll compressor has a variable crank mechanism.

Figure 6:
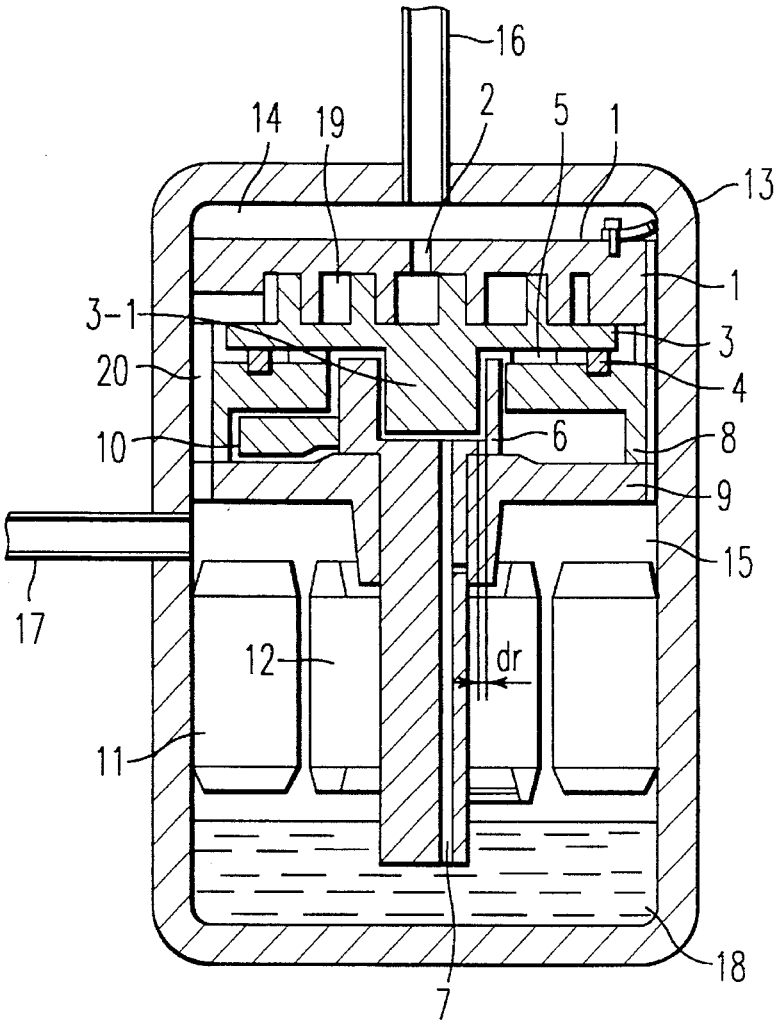
FIG. 6 is an illustration which explains the regulation of orbital radius of the longitudinal type scroll compressor of the fixed crank mechanism of the an embodiment of the present invention.

But, in case of the scroll compressor having a fixed crank mechanism system, the interference can be solved from the following explanation and FIG. 6.

FIG. 6 is an illustration which explains the regulation of orbital radius of the longitudinal type scroll compressor of the fixed crank mechanism of an embodiment of the present invention.

That is, in case that the scroll compressor has the fixed crank mechanism, the interference distances at the contact points A1~A3 can be canceled by allowing the orbital radius to be small by the clearance $d_r$ between the principal axis 6 and the boss portion 3-1 of the orbital scroll 3 when the orbital scroll 3 is driven by the principal axis 6 as shown in FIG. 6.

The clearance $\delta_1$ between the wrap members of the orbital scroll 3 and the fixed scroll 1 increases in proportion to the rotation angle $\psi$ of the orbital scroll 3 as shown in the above equation (2) and in FIG. 4. In other words, it is easily understood that the greater the clearance at the non-sliding side of the Oldham ring is, the greater the reducing effect of the interference becomes.

However, the rotation quantity of the orbital scroll 3 cannot be infinity. In case of the scroll compressor, the clearance of the side surface of the scroll wrap which forms the closed space becomes two times the crank radius at maximum and zero at minimum from the geometrical restriction.

According to the mechanism of the present invention, when the orbital scroll 3 rotates on its own axis, the clearance $\delta_1$ is formed as described in equation (2). But, it is not larger than the maximum value 2r which is the clearance of the tooth side surface.

That is, $$\delta_1 max=2r \quad (3)$$

where, $$r = (p-2t)/2 = a(\pi-2\alpha) \quad (4)$$

and p: wrap pitch, t: thickness of wrap tooth, r: crank radius, a: radius of wrap circles, $\alpha$: angle of tooth thickness.

In equation (2), a is constant, then;

$$\delta_1 max=2a\psi max \quad (5)$$

From equations (3), (4) and (5), $$2a\psi max=2a(\pi-2\alpha)$$

$$\psi max=\pi-2\alpha \quad (6)$$

Therefore, the maximum value of the rotation quantity of the orbital scroll 3 is obtained as $\psi$ max from the above equation (6).

The decreasing quantity $\Delta r$ of the crank radius of the orbital scroll 3 is given from the equation (1) as follows.

$$\Delta r\,max = a\Psi\,max = a(\pi-2\alpha)$$

Therefore, it is easily understood that the following equation is obtained from equation (4).

$$\Delta r\ max=r$$

In other words, the orbital scroll 3 loses a crank radius and the orbital scroll 3 does not make the orbital motion. Therefore, even if the principal axis rotates, the orbital scroll 3 continues to be in a stationary state.

Accordingly, in order to get the satisfactory reducing effect, it is only enough to set the clearance $\epsilon$ between the key and the key groove to the corresponding non-sliding side surface without exceeding the maximum range of $\psi$ max.

FIG. 1~FIG. 3 describe the expansion of the key groove of the main frame 8, but the similar effect can be obtained when the key groove of the orbital scroll 3 is expanded or the Oldham ring key width is reduced. In the latter case, there is an advantage in that the workability is improved since the large clearance between the Oldham ring key and the key groove at the non-sliding side can be obtained.

Embodiment 2

FIG. 7–FIG. 10 are main cross sectional views of the key and the key groove of the second embodiment of the present invention.

The second embodiment is explained using FIG. 7~FIG. 10.

FIG. 1 of the first embodiment describes the clearance between the wrap member side surfaces which is generated from the rotation of the orbital scroll 3.

Figure 7:
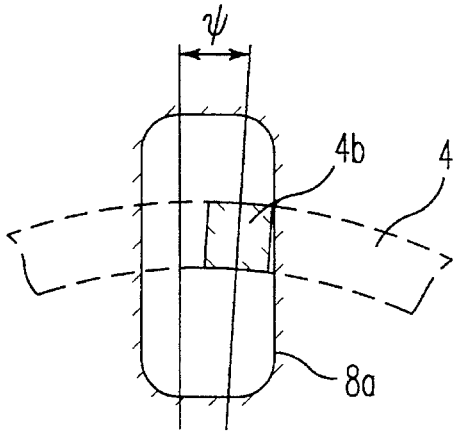
FIG. 7 is a main cross sectional view of the key and the key groove of the second embodiment of the present invention.

In FIG. 7, in case of using the key groove **8*a* which is simply expanded in parallel as easily understood, the key groove 8*a* contacts the Oldham ring key 4*b* at one side of it during the rotation of the orbital scroll 3. Therefore, the contact area of the key 4*b* and key groove 8*a*** decreases and the sliding surface force becomes abnormally high. Accordingly, this second embodiment is intended to prevent the above partial contact and to cause the key and the key groove to slide on the full surface and to prevent an abnormal abrasion and seizure.

Figure 8:
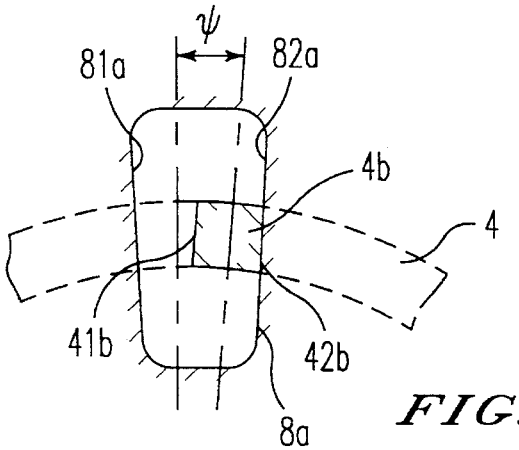
FIG. 8 is a main cross sectional view of the key and the key groove of the second embodiment of the present invention.

In FIG. 8, the key groove wall of Oldham ring 4 is formed to be non-parallel to the sliding side surface. That is, in the second embodiment, an angle of the sliding side surface 82*a* is deformed so that the sliding side surface 42*b* contacts the sliding side surface 82*a* of the key groove along the parallel surface while the orbital scroll 3 rotates on its own axis toward the reverse rotational direction around the principal axis.

Figure 9:
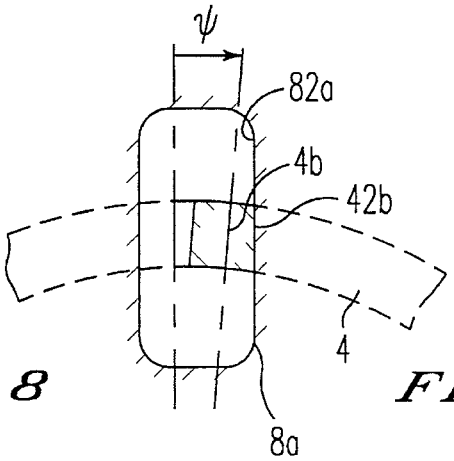
FIG. 9 is a main cross sectional view of the key and the key groove of the second embodiment of the present invention.

This partial contact can be prevented even if the key groove is formed in parallel as shown in FIG. 9. In the figure, the partial contact between the key and the key groove can be prevented while the sliding scroll is rotating by deforming an angle of the non-sliding side surface 42*b* of the Oldham ring key.

Figure 10:
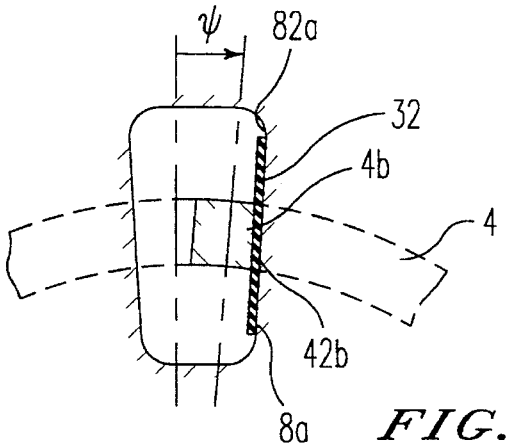
FIG. 10 is a main cross sectional view of the key and the key groove of the second embodiment of the present invention.

As shown in FIG. 10, a cushioning material (elastic body) 32 is provided between the non-sliding side surfaces 42*b* and 82*a*. This cushioning material relaxes a shock when the key and the key groove of the Oldham ring key collides while the sliding scroll rotates on its own axis.

Embodiment 3

FIG. 11A~FIG. 11D and FIG. 12 are main cross sectional views of the key and the key groove of the third embodiment of the present invention. The third embodiment is explained using FIG. 11A~FIG. 11D and FIG. 12.

In the above embodiment of the present invention, the clearance between the wrap side surfaces generated during the orbital scroll rotation is provided only at one side of corresponding compression chambers. The clearance can be provided, however, at respective sides of the corresponding compression chambers by deforming non-sliding side surface shapes.

In FIG. 11A~FIG. 11D, a stage portion 83*a* is formed at the non-sliding side surface 82*a* of the key groove. The stage portion 83*a* forces to limit the orbital radius of the orbital scroll 3 by causing the key 4*b* to collide to the sliding side surface of the stage portion 83*a* during the reciprocating motion when the Oldham ring key is positioned at the sliding side surface while the orbital scroll 3 is rotating toward the reverse rotational direction around the principal axis.

Figure 11A:
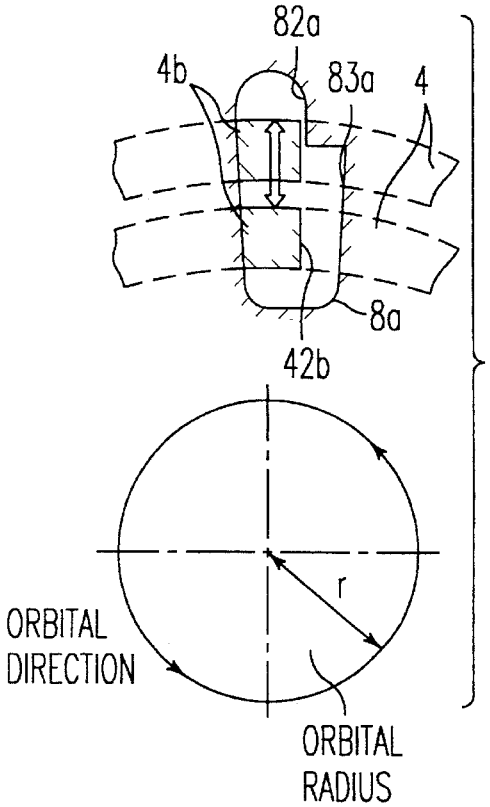
FIG. 11A and FIG. 11B show a stage portion formed at the non-sliding side surface of the key groove of the third embodiment of the present invention.

In the normal operation, the orbital scroll 3 rotates under keeping a desired orbital radius r as shown in FIG. 11A. On the other hand, in case that the orbital scroll 3 rotates and the Oldham ring key slides at the non-sliding side surface, the contacting state between the key 4*b* and the stage portion 83*a* is shown in FIG. 11B.

Figure 11B:
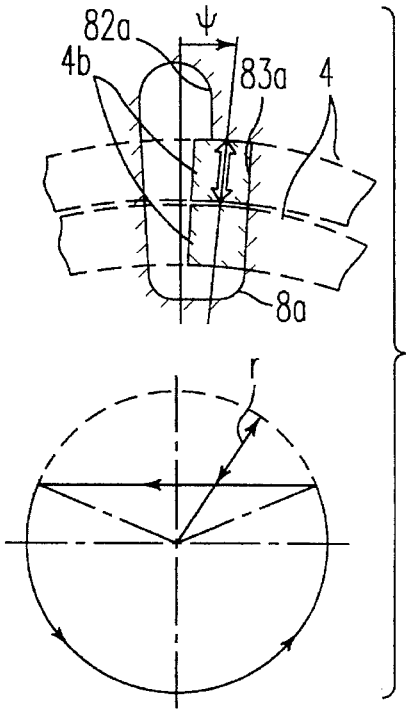

In FIG. 11B, the orbital radius r of the orbital scroll is limited during the collision of the Oldham ring key to the stage portion 83*a*. This limited orbital radius r causes the clearance generated between the wrap side surfaces to be larger because the driving bush 21 of the variable crank mechanism goes backward.

Furthermore, the wrap side surface clearance $\delta_1$ generated only by the rotation of the orbital scroll 3 is generated only at the contact points A4~A6 in FIG. 1~FIG. 3. On the other hand, in case that the orbital radius (r) is forced to be limited, the clearance is also generated at the points A1~A3 as well as the contact points A4~A6.

Figure 11C:
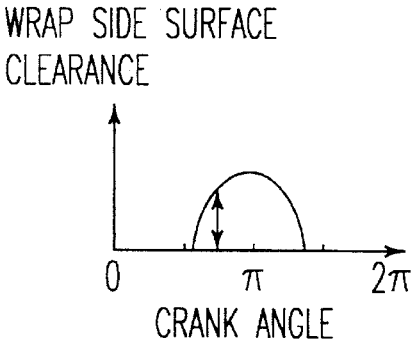
FIG. 11C shows a clearance of the wrap member side surface generated by one of the stage 83a of the key groove of FIG. 11B.
Figure 11D:
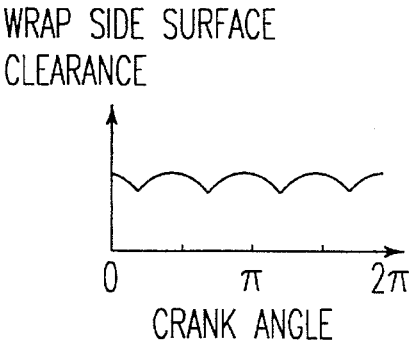
FIG. 11D shows a clearance of the wrap side surface in case that a plurality of same stages are formed on the sides of the key grooves.

The clearance between the wrap member side surfaces generated by one stage 83*a* of the key groove of FIG. 11B is illustrated in FIG. 11C for one crank rotation. Since there are four key grooves, the clearance of the wrap side surface is increased as shown in FIG. 11D, if the same stage portions are formed on all four sides of the key grooves.

Figure 12:
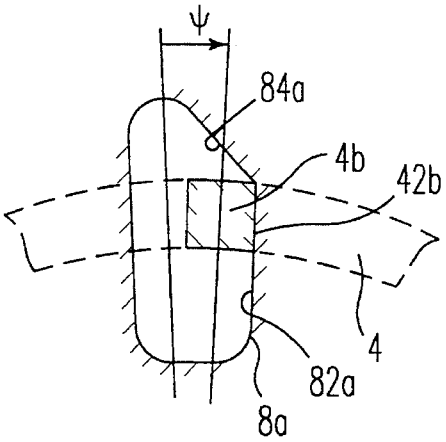
FIG. 12 is a main cross sectional view of the key and the key groove of the third embodiment of the present invention and shows an inclined surface formed instead of the stage portion in FIG. 11A and FIG. 11B.

FIG. 12 is a main cross sectional view of the key and the key groove of the third embodiment of the present invention. In FIG. 12, an inclined surface 84*a* is formed instead of the stage portion 83*a* in FIGS. 11A and 11B. The Oldham ring key slides along the inclined surface and prevents the direct collision onto the stage portion and relaxes the collision shock. As soon as the Oldham ring key comes into contact with the non-sliding surface of the key groove after the orbital scroll 3 starts the rotation, the orbital radius r can be forced to be limited before the key collides to the stage portion.

Embodiment 4

Figure 13:
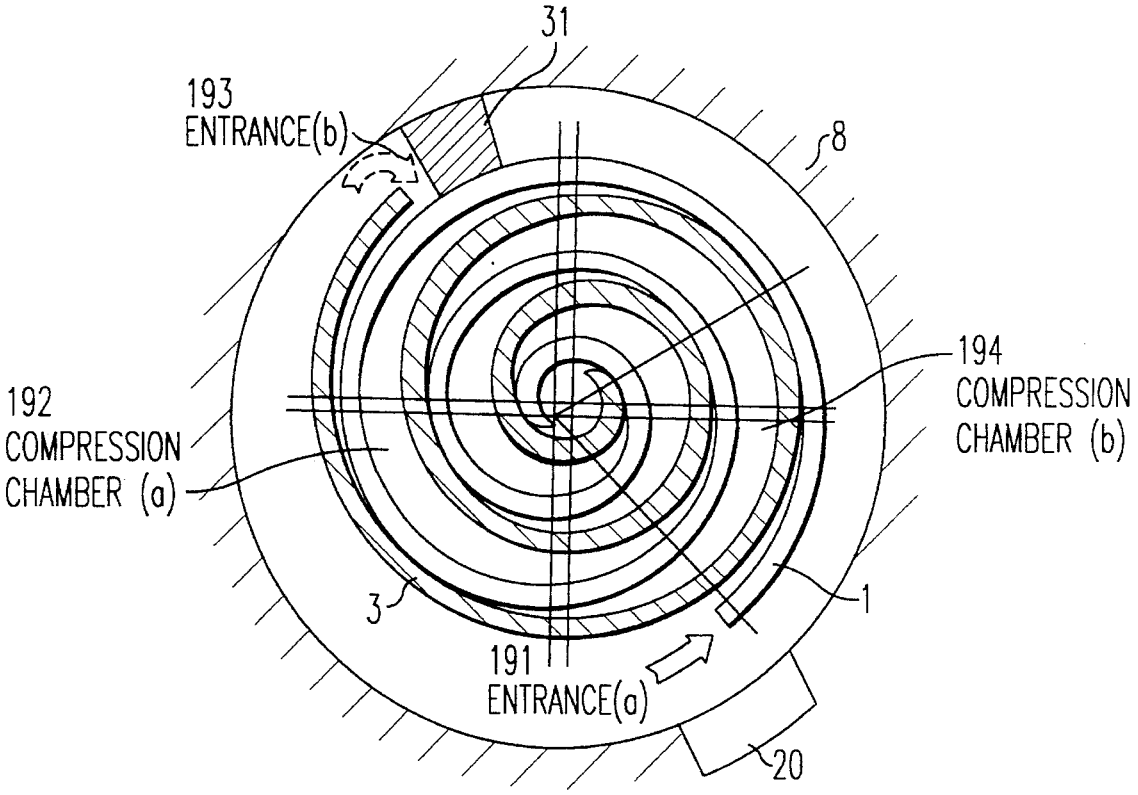
FIG. 13 is a main cross sectional view of a scroll compressor of the fourth embodiment of the present invention.

FIG. 13 is a main cross sectional view of a scroll compressor of the fourth embodiment of the present invention. The fourth embodiment is explained using FIG. 13.

In FIG. 13, an obstacle 31 which functions as a flow resistor is fixed on the outside surface of the fixed wrap member 1 near the entrance (b) 193 of the compression chamber (b) 194.

Even if a lot of formed liquid refrigerant flows into the wrap member space, the obstacle 31 may restrict the suction quantity of the liquid refrigerant into the compression chamber (b) 194 at near the entrance (b) 193. On the other hand, the compression chamber (a) 192 continues to compress the refrigerant containing a lot of liquid. As a result, the pressure difference between the compression chamber (a) and (b) becomes larger compared to the case where there is no obstacle 31. As described above, the obstacle 31 positively breaks the torque balance between the two compression chambers and helps to assure the reduction operation.

Embodiment 5

Figure 14A:
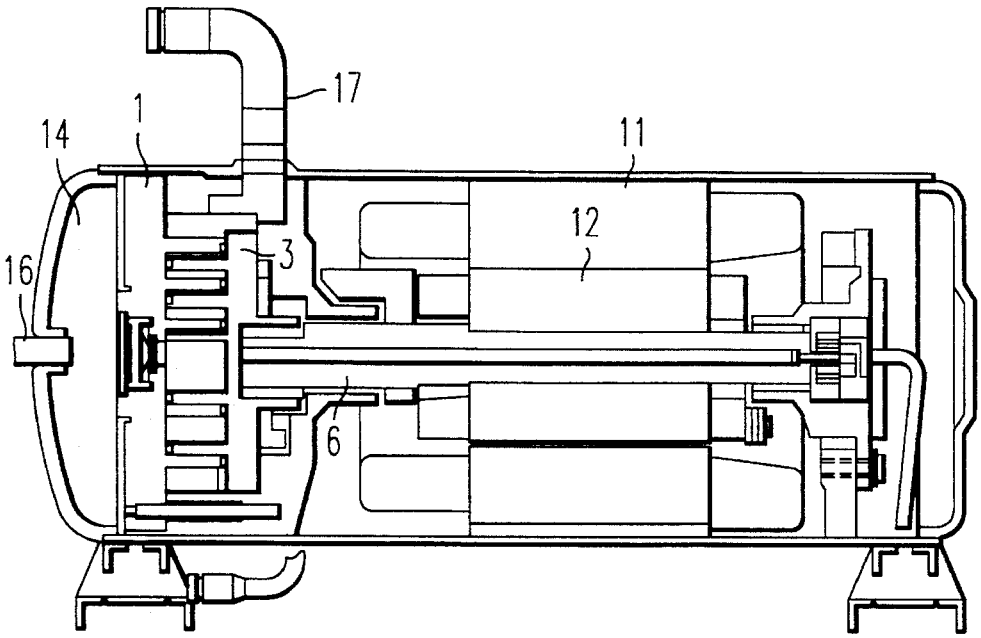
FIG. 14A is a main cross sectional view of a transverse type scroll compressor of the fifth embodiment of the present invention.
Figure 14B:
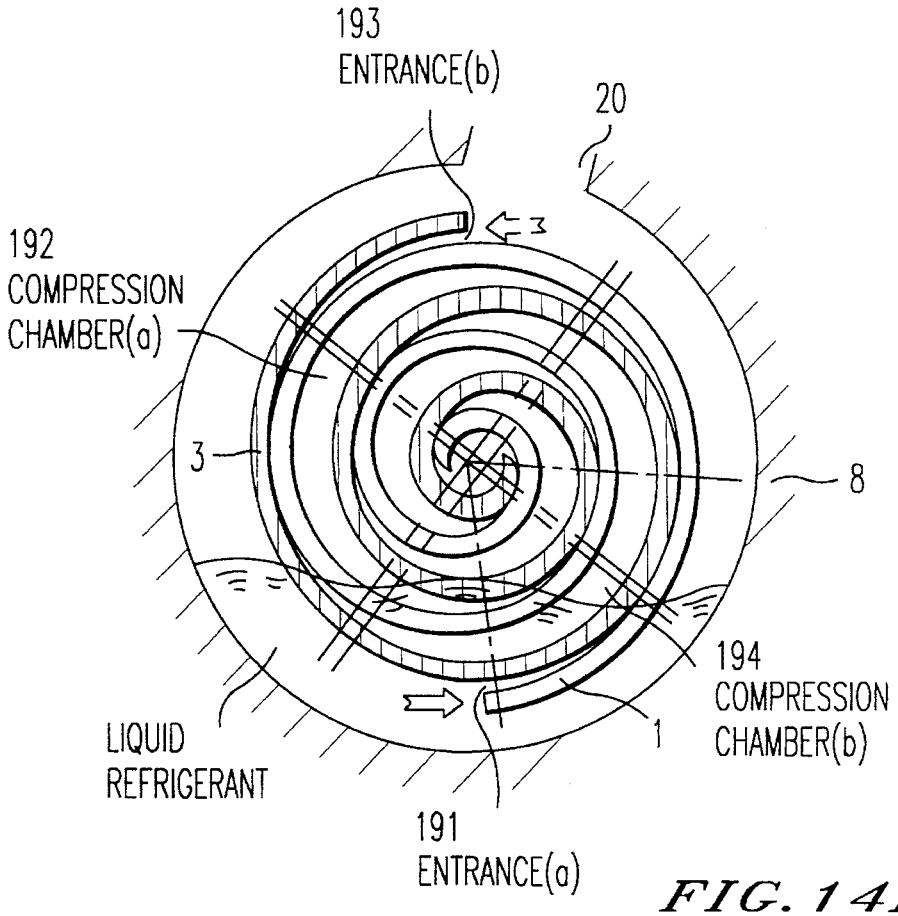
FIG. 14B shows a compression mechanism of the fifth embodiment of the present invention.

The fifth embodiment is explained using FIG. 14A and FIG. 14B.

FIG. 14A is a cross sectional view of a transverse type scroll compressor. For the transverse type scroll compressor, the wrap members in the compression mechanism are apt to be soaked into the liquid refrigerant compared to the longitudinal type scroll compressor in which the wrap members are located at an upper portion of the scroll compressor shell.

FIG. 14B shows the compression mechanism in the transverse type scroll compressor shell. It is easily understood from the figure that the wrap members are apt to be soaked into the liquid refrigerant even if a small amount of the liquid refrigerant exists in the compression mechanism. In the scroll compressor having such a mechanism, the entrance (a) 191 is located toward the gravity direction in this embodiment in order that the invention functions effectively.

When the scroll compressor is started from this stopping state, the pressure in the compression chamber (a) 192 abruptly rises almost at the same time as the compressor starts, because the liquid refrigerant at the entrance (a) 191 has been already soaked in the compressor shell. Therefore, the pressure imbalance is apt to occur easily in the present construction at starting. If the pressure imbalance occurs, since the pressure is decreased by the function of the present invention, the wrap member can avoid the danger of excessive pressure load.

Embodiment 6

Figure 15:
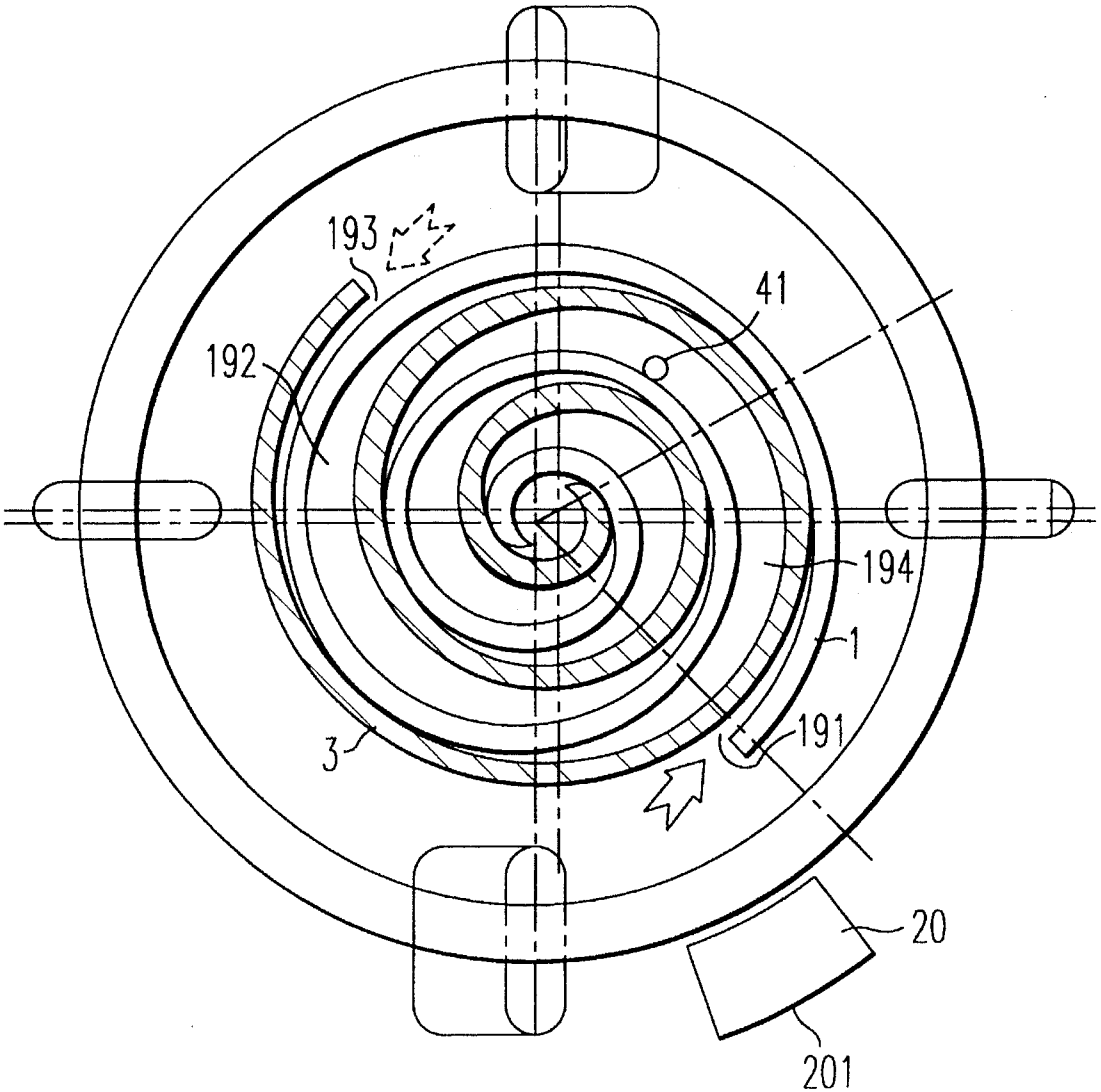
FIG. 15 is a main cross sectional view of a scroll compressor of the sixth embodiment of the present invention.
Figure 16:
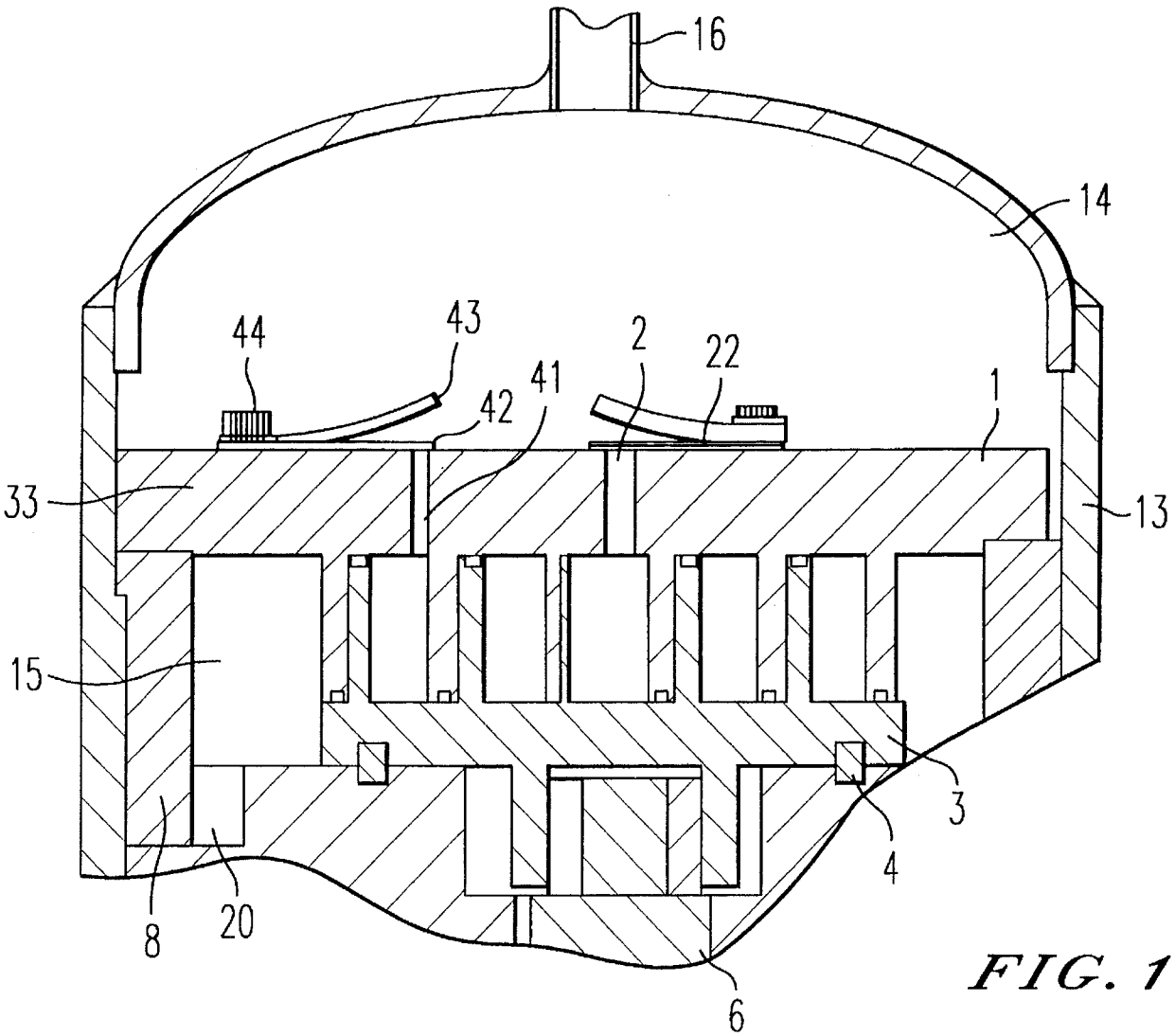
FIG. 16 is a main cross sectional view of a scroll compressor of the sixth embodiment of the present invention and shows a hole and a valve.

The sixth embodiment is explained using FIG. 15 and FIG. 16.

FIGS. 15 and 16 are main cross sectional views of a scroll compressor of the sixth embodiment of the present invention. In FIG. 15, one or more holes 41 with a valve 42 (check valve) are equipped which by-passes the liquid refrigerant from the compression chamber (b) 194 to the discharge muffler space 14.

FIG. 16 is a cross sectional view of FIG. 15 looked at from the transversal direction. Since the pressure in the muffler 14 is higher than the pressure in the compression chamber during a normal operation, airtightness of the compression chamber is kept at a desired operation state by the valve 42. On the other hand, in case that the liquid refrigerant is compressed, the foamed refrigerant having high pressure in the compression chamber (b) 194 is discharged via the hole 41 and the valve 42 to the muffler space 14, and then the abnormally raised pressure is decreased.

Alternatively, the pressure in the compression chamber (a) 192 rises in response to the decrease of the compression chamber volume because it has no hole 41. Therefore, as described above, since the respective pressures in the two compression chambers are positively differentiated, the torque balance is broken and the rotating moment which rotates against the principal axis is given to the orbital scroll 3. Accordingly, the safe operation is attained.

In case the clearance between the Oldham ring key and the key groove of the sliding surface is large, the scroll compressor has the following further advantages.

For example, when the crank shaft rotates toward reverse rotational direction, an opposite sliding side surface of the Oldham ring key and the Oldham key groove contacts each other compared to the normal rotational operation.

In the conventional scroll compressor, when it rotates toward the reverse rotational direction, the phase difference of the wrap member is kept to 180 degrees and no clearance is generated between the wrap side surfaces, because the clearance $\epsilon$ between the key and key groove has very small value. As a result, the scroll compressor functions as an expansion engine. Therefore, the compression chamber near the center of the wrap member approaches extremely to high vacuum state.

In the scroll compressor, the temperature of the wrap members rises high by refrigerant compression or by friction heat generated by the contact of the wrap side surfaces. But in the normal operation of the scroll compressor, the wrap members are cooled by the cooling function of the cyclic refrigerant in order to not exceed a certain temperature.

The temperature at the wrap member which is generated by the compression of the refrigerant or the mutual contact of the wrap surfaces becomes high, but it is cooled by the circulating refrigerant circulation.

However, when the scroll compressor rotates toward the reverse rotational direction, the compression chamber near the center of the wrap members ultimately closes to a vacuum state. As a result, the orbital scroll 3 is raised toward the axis direction by the negative force, and the teeth of the wrap members of the orbital scroll 3 contact the teeth of the wrap members of the fixed scroll 1.

When the friction heat is generated at such teeth points of the wrap members or the wrap side surfaces, the temperature of the wrap members continues to increase because there is no circulation of the refrigerant in the compression chamber nor cooling function of the refrigerant itself. If the wrap member is expanded by the heat and the expanded value exceeds a predetermined clearance value of the wrap teeth, the wrap members bump each other and the wrap members will seize up and finally beak down.

But, in the scroll compressor of the present invention, when it rotates toward the reverse rotational direction, the key and the key groove slide at the non-sliding surface which is opposite surface when the scroll compressor rotates toward the normal rotational direction. In this state, the wrap members rotate with a certain deviated phase difference from 180 degrees. As a result, one side of the compression chamber causes the refrigerant to expand, but the other side of the compression chamber decreases an extent of the vacuum because clearances are generated at the other side of the compression chambers.

Accordingly, this clearance causes a flow path of the refrigerant which flows from the outside to the inside of the wrap members. This flow of the refrigerant cools the friction heat generated by the contact of the wrap side surfaces when the scroll compressor rotates toward the reverse rotational direction. Accordingly, the breakage of the wrap member occurred by thermal expansion can be prevented.

Figure 17:
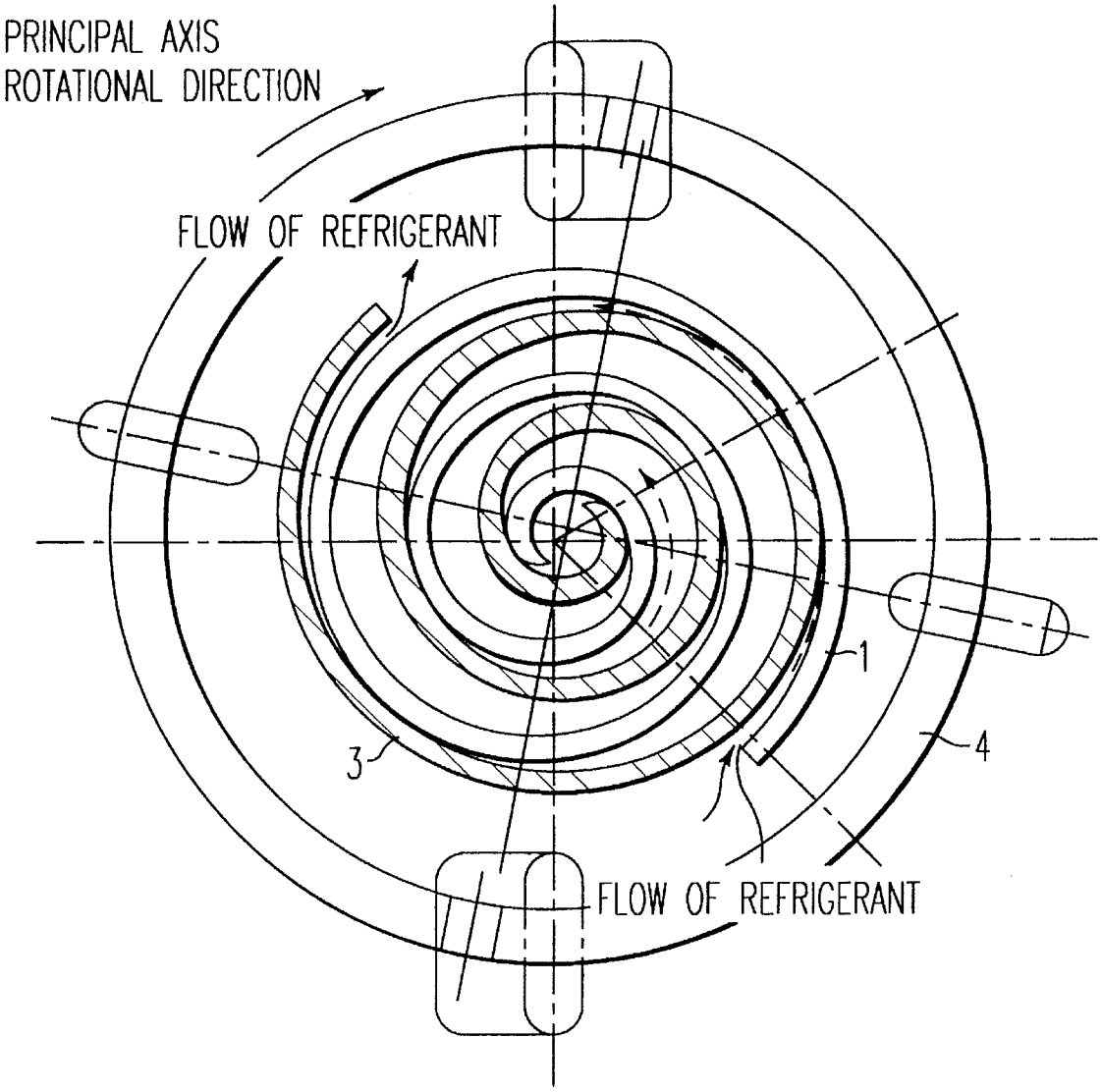
FIG. 17 is a main cross sectional view of a scroll compressor in case of the reverse rotation of the embodiment of the present invention.

FIG. 17 is a main cross sectional view of a scroll compressor in case of the reverse rotation. In the figure, it is shown that the refrigerant is flowing through the clearance formed between two wrap members.

Figure 18A:
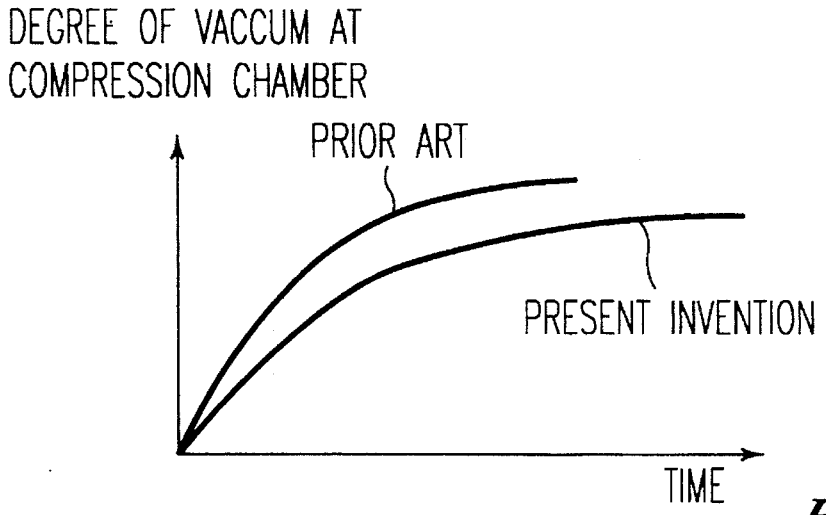
FIG. 18A is an illustration which shows a relation between the time from the starting of the scroll compressor and the degree of vacuum at the compression chamber during reverse rotation of the embodiment of the present invention.

FIG. 18A is an illustration which shows a relation between the time from the starting of the scroll compressor and the degree of vacuum at the compression chamber during reverse rotation of the embodiment of the present invention.

Figure 18B:
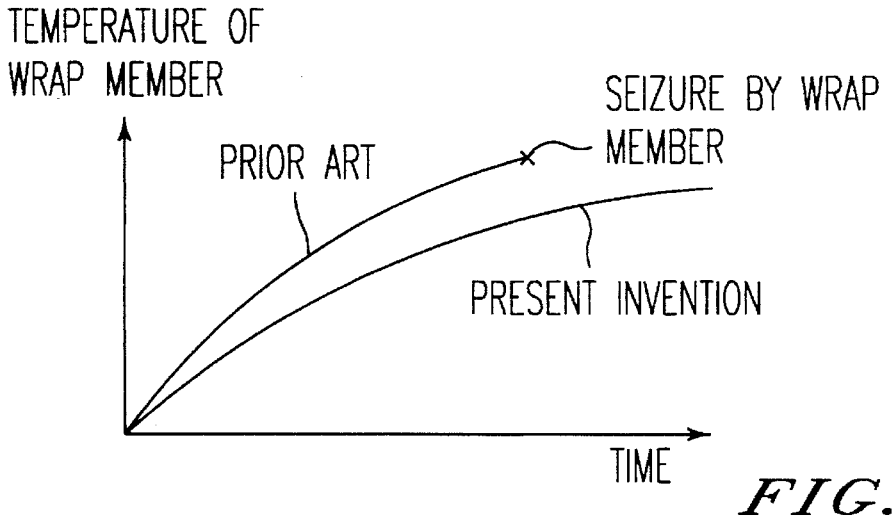
FIG. 18B is an illustration which shows a relation between the time from the starting of the scroll compressor and the temperature of the wrap member during reverse rotation of the embodiment of the present invention.
Figure 19:
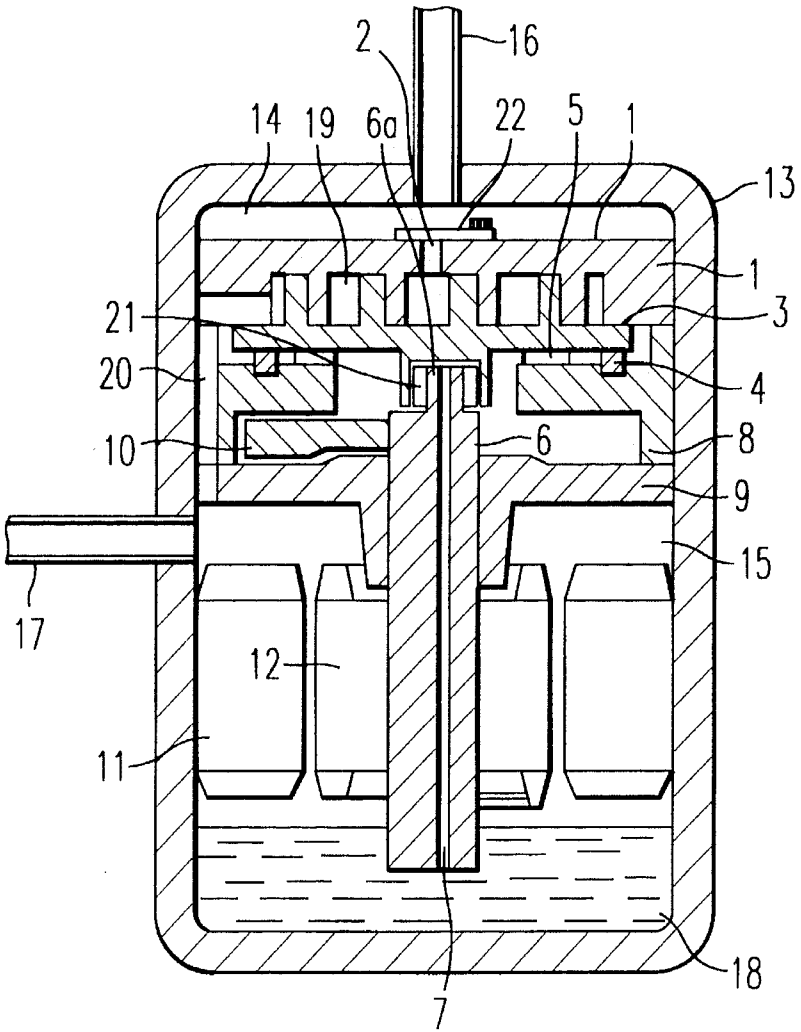
FIG. 19 PRIOR ART
FIG. 19 is a main cross sectional view of a conventional longitudinal scroll compressor.
Figure 20:
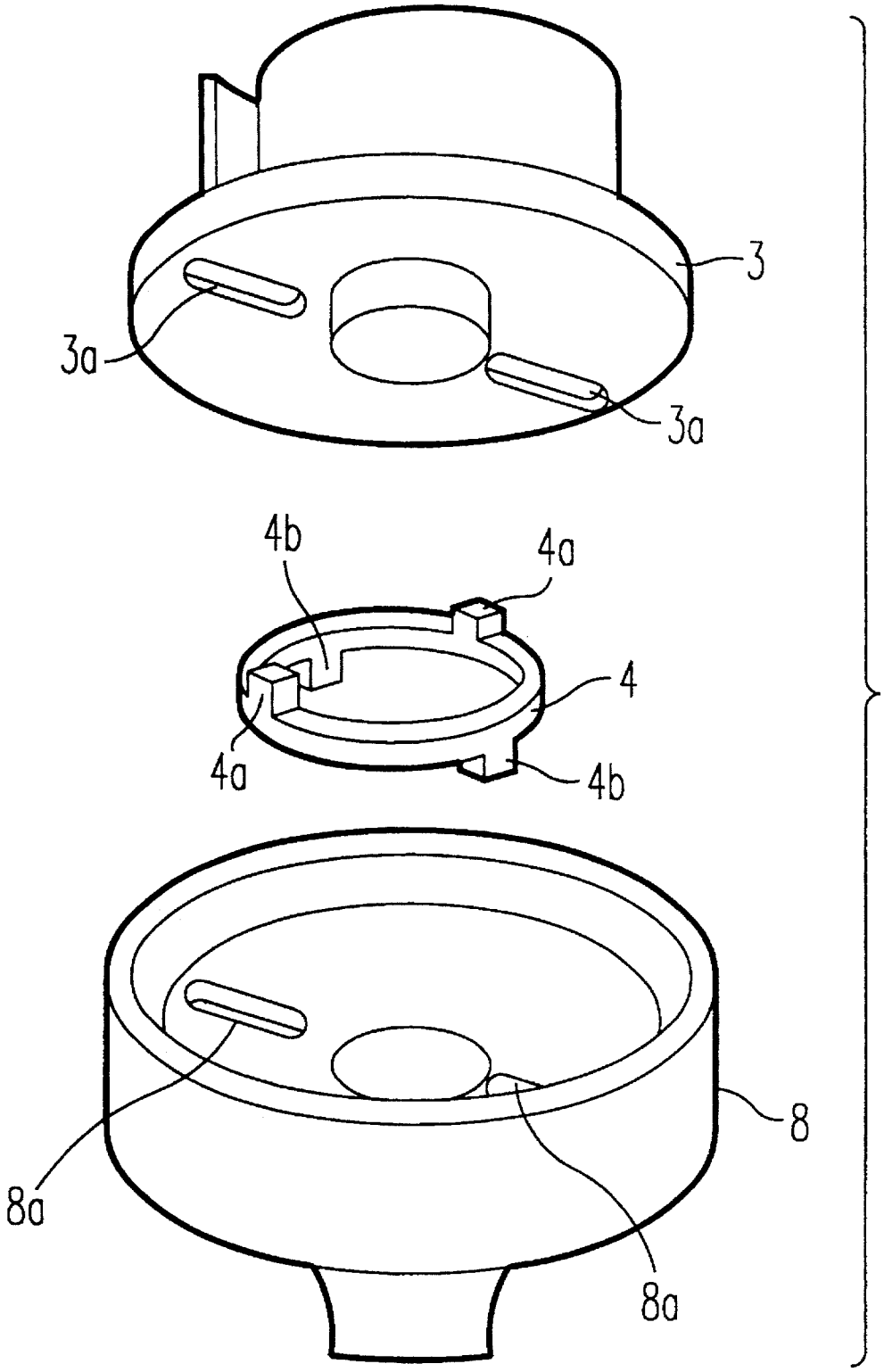
FIG. 20 PRIOR ART
FIG. 20 is an illustration of the Oldham ring in a conventional scroll compressor.
Figure 21:
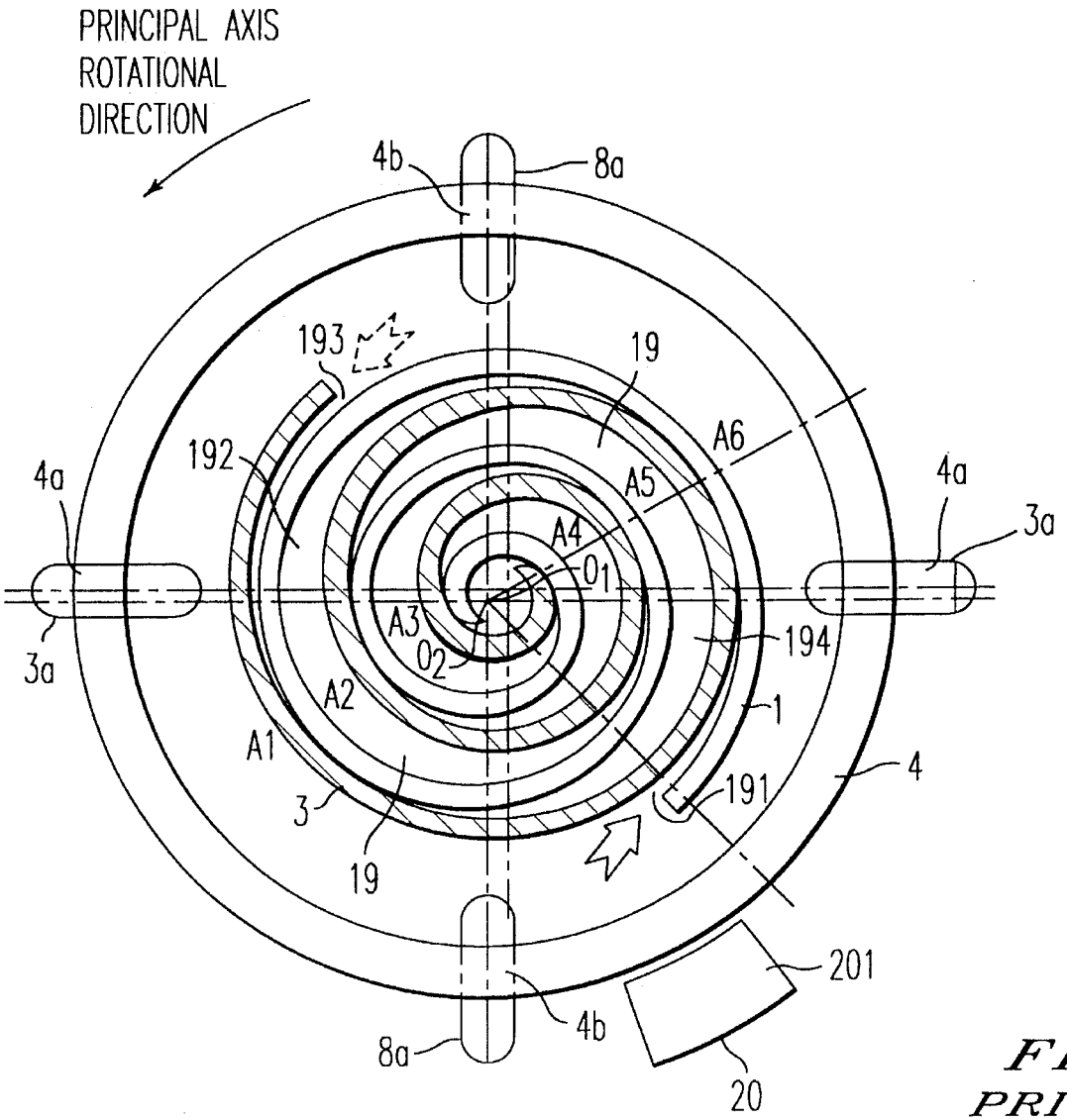
FIG. 21 PRIOR ART
FIG. 21 is a main cross sectional view which shows a compression mechanism of the conventional scroll compressor.
Figure 22:
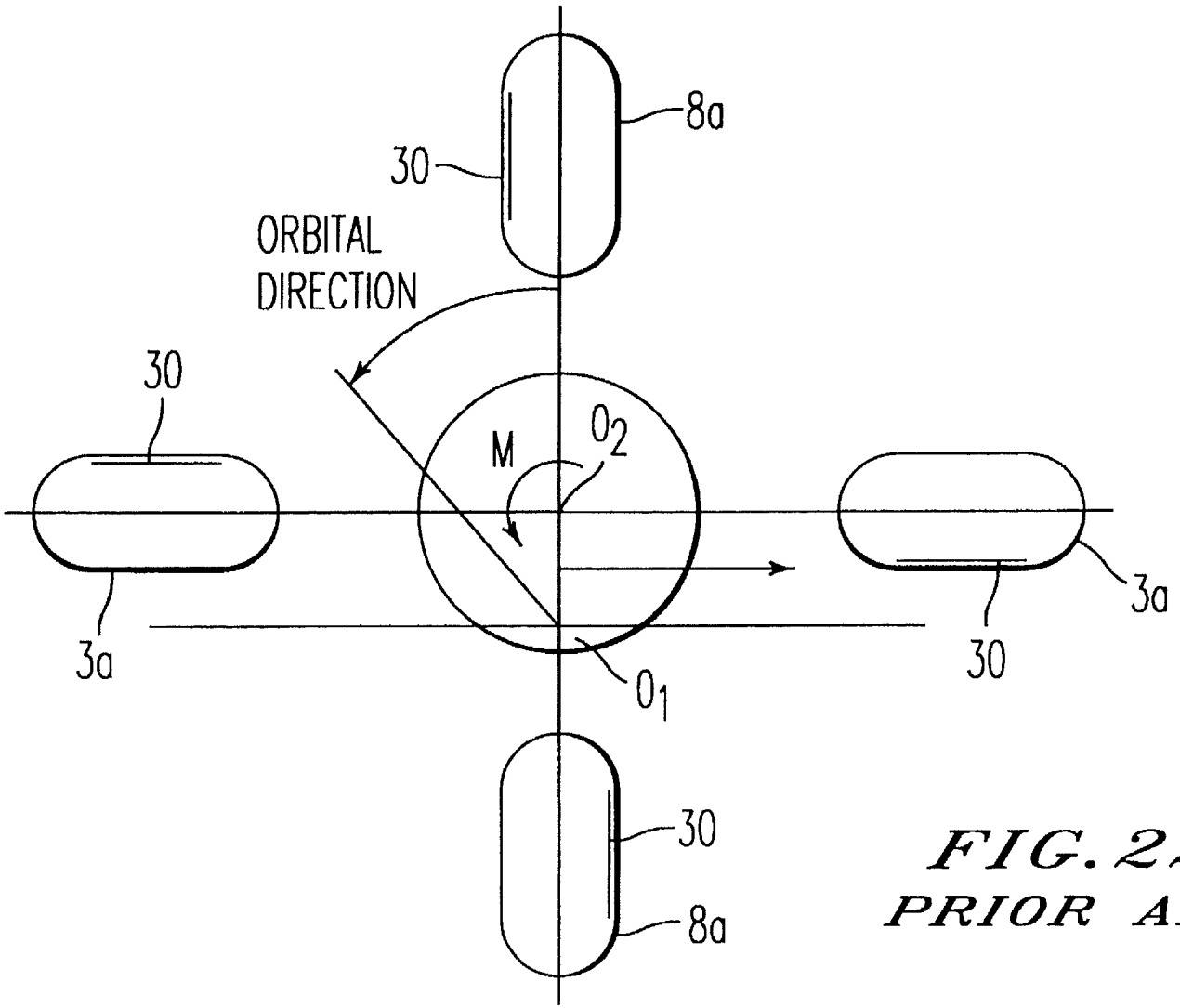
FIG. 22 PRIOR ART
FIG. 22 is an illustration which shows the rotational moment acting on the orbital scroll at the normal operation of the conventional scroll compressor.
Figure 23:
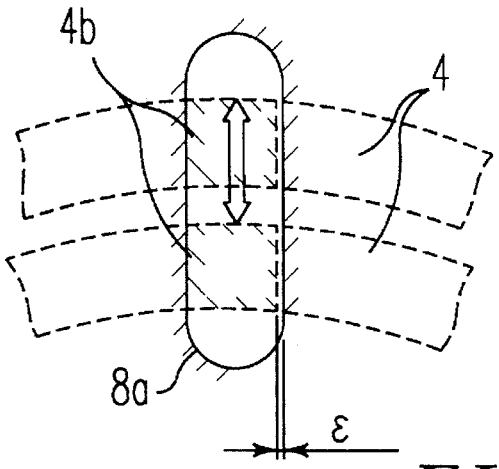
FIG. 23 PRIOR ART
FIG. 23 is a cross sectional view which shows the key and the key groove of the conventional scroll compressor.
Figure 24:
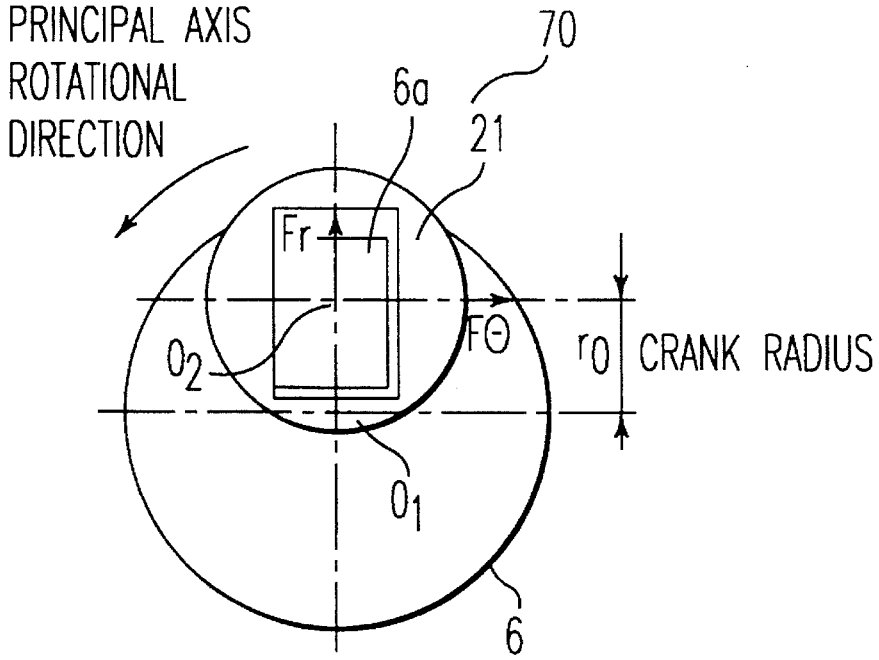
FIG. 24 PRIOR ART
FIG. 24 is a main cross sectional view which shows the variable crank mechanism.

FIG. 18B is an illustration which shows a relation between the time from the starting of the scroll compressor and the temperature of the wrap member during reverse rotation of the embodiment of the present invention. It is easily understood that the temperature rise of the wrap member is decreased from FIG. 18B even at the reverse rotation in the present invention.

The reverse rotation state occurs, for example, when the three phase alternating power source is not properly connected at setting up an air conditioner. The reverse rotation state continues for a certain time until it is found. If the scroll compressor can not endure the stress during the time, it will break down. Since the temperature rise of the wrap member is decreased during reverse rotation, the present invention gives a large reliability in case of the reverse rotation of the scroll compressor.

Those skilled in the art will recognize that many modifications to the foregoing description can be made without departing from the spirit of the invention. The foregoing description is intended to be exemplary and in no way limiting. The scope of the invention is defined in the appended claims and equivalents thereto.

What is claimed as new and desired to be secured by Letters Patent of the United States is:

1. A scroll compressor comprises a fixed scroll defined by wrap teeth having a spiral shape which is formed on one side of a first bed plate, an orbital scroll defined by wrap teeth having substantially the same spiral shape as that of the fixed scroll which is formed on one side of a second bed plate, said both wrap teeth are arranged so that they have a relative phase difference differentiated by 180 degrees and form a plurality of closed compression chambers, a volume of said closed compression chambers are gradually decreased and compressed by a relative orbital motion of the orbital scroll and the fixed scroll, the scroll compressor comprising:

rotation constraining means for restricting a rotation of the orbital scroll toward a principal axis rotational direction and maintaining the relative phase difference of said both wrap teeth differentiated by substantially 180 degrees, and for extending a constraining range of the orbital scroll toward the principal axis reverse rotational direction and changing the relative phase difference of said both wrap teeth; and compression chamber torque forming means for causing a pressure in first compression chambers which is larger than that in second compression chambers when the pressure in the compression chambers rises up abnormally high, wherein the first compression chambers are formed between a wrap member inside surface of the fixed scroll and a wrap member outside surface of the orbital scroll and the second compression chambers are formed between a wrap member outside surface of the fixed scroll and a wrap member inside surface of the orbital scroll, wherein a rotation of the orbital scroll about its own axis toward a reverse rotational direction of the principal axis permits a clearance to be formed between contact points of the fixed scroll and the orbital scroll in a vicinity of the first compression chambers and causes a zero clearance between the contact points of the fixed scroll and the orbital scroll in a vicinity of the second compression chambers.

2. The scroll compressor according to claim 1 further comprising:

a variable crank structure for varying an orbital radius of the orbital scroll.

3. The scroll compressor according to claim 1, wherein said rotation constraining means comprises an Oldham coupling for constraining the orbital scroll against the fixed scroll toward the reverse rotational direction of the principal axis, wherein the constraining range is set at minimum to a rotation quantity corresponding to a sliding surface fitting clearance which is normally set at machining the Oldham coupling, and also the constraining range is set at maximum to a rotation quantity corresponding to a clearance where the crank radius of the orbital scroll becomes zero.

4. The scroll compressor according to claim 2, wherein said rotation constraining means comprises an Oldham coupling for constraining the orbital scroll against the fixed scroll toward the reverse rotational direction of the principal axis, wherein the constraining range is set at minimum to a rotation quantity corresponding to a sliding surface fitting clearance which is normally set at machining the Oldham coupling, and also the constraining range is set at maximum to a rotation quantity corresponding to a clearance where the crank radius of the orbital scroll becomes zero.

5. The scroll compressor according to one of claims 3 or 4, wherein said reverse rotational direction of the principal axis of the orbital scroll is restricted by extending an Oldham groove width or reducing an Oldham key width.

6. The scroll compressor according to claim 5, wherein a sliding surface of the Oldham groove and a sliding surface of the Oldham key are in parallel when the orbital scroll rotates toward the reverse rotational direction of the principal axis.

7. The scroll compressor according to claim 5, wherein an elastic body is equipped on an Oldham groove side surface which becomes a sliding side when the orbital scroll rotates toward the reverse rotational direction of the principal axis.

8. The scroll compressor according to claim 5, wherein at least a stage is formed on an Oldham groove side surface which becomes a sliding side when the orbital scroll rotates toward the reverse rotational direction of the principal axis.

9. The scroll compressor according to claim 5, wherein an inclined surface is formed on an Oldham groove side surface which becomes a sliding side when the orbital scroll rotates toward the reverse rotational direction of the principal axis.

10. The scroll compressor according to one of claims 1, 2, 3 or 4, wherein said compression torque forming means comprise a suction path aperture which is formed near an entrance of said first compression chambers rather than the second compression chambers.

11. The scroll compressor according to one of claims 1, 2, 3 or 4, wherein said compression torque forming means comprise a flow resistor which is formed in a refrigerant flow path near an entrance of said second compression chambers.

12. The scroll compressor of a transverse type according to one of claims 1, 2, 3 or 4, wherein said compression torque forming means comprise an entrance of said first compression chambers which is located at a lower half of a horizontal direction of the transverse type scroll compressor.

13. The scroll compressor according to one of claims 1, 2, 3 or 4, wherein said compression torque forming means comprise a valve for connecting said second compression chamber to a discharging space.

* * * * *